US010423095B2

(12) United States Patent
Takahashi et al.

(10) Patent No.: US 10,423,095 B2
(45) Date of Patent: Sep. 24, 2019

(54) DEVELOPING APPARATUS HAVING A SEALING SHEET AND UNSEALING MECHANISM

(71) Applicant: CANON KABUSHIKI KAISHA, Tokyo (JP)

(72) Inventors: Masafumi Takahashi, Tsukubamirai (JP); Hitoshi Kubota, Tokyo (JP); Yohei Gamo, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/827,254

(22) Filed: Nov. 30, 2017

(65) Prior Publication Data

US 2018/0164714 A1 Jun. 14, 2018

(30) Foreign Application Priority Data

Dec. 14, 2016 (JP) ..... 2016-242444

(51) Int. Cl.
*G03G 15/08* (2006.01)

(52) U.S. Cl.
CPC ..... *G03G 15/0881* (2013.01); *G03G 15/0817* (2013.01); *G03G 15/0822* (2013.01); *G03G 15/0882* (2013.01); *G03G 15/0884* (2013.01); *G03G 15/0886* (2013.01); *G03G 15/0891* (2013.01); *G03G 15/0893* (2013.01);
(Continued)

(58) Field of Classification Search
CPC ..... G03G 15/0817; G03G 15/0822; G03G 15/0881; G03G 15/0882; G03G 15/0884; G03G 15/0886; G03G 15/0891; G03G 15/0893; G03G 15/0894; G03G 15/0898; G03G 2215/0668; G03G 2215/0687; G03G 2215/069; G03G 2215/0692
See application file for complete search history.

(56) References Cited

U.S. PATENT DOCUMENTS 8,855,525 B2 10/2014 Muto et al.
9,645,527 B2 * 5/2017 Saito ..... G03G 15/0856
(Continued)

FOREIGN PATENT DOCUMENTS

JP 2002-072686 A 3/2002
JP 2003-005517 A 1/2003
(Continued)

*Primary Examiner* — Joseph S Wong
(74) *Attorney, Agent, or Firm* — Venable LLP

(57) ABSTRACT

A developing apparatus includes a developer bearing member bearing and feeding developer including toner and carrier, a first feeding screw arranged in a first chamber and feeding the developer in a first direction, and a second feeding screw arranged in a second chamber and including a first blade portion feeding the developer in a second direction, a second blade portion arranged downstream of the first blade portion and feeding the developer in the first direction, and a third blade portion arranged downstream of the second blade portion. A sealing sheet is arranged upstream of a developer discharging portion and seals initial developer contained in a developing container; and an unsealing mechanism unseals the sealing sheet sealing the initial developer, wherein the sealing sheet is arranged downstream of the second blade portion and upstream of the third blade portion in the second direction.

9 Claims, 16 Drawing Sheets

(52) U.S. Cl.
CPC ..... *G03G 15/0894* (2013.01); *G03G 15/0898* (2013.01); *G03G 2215/069* (2013.01); *G03G 2215/0668* (2013.01); *G03G 2215/0687* (2013.01); *G03G 2215/0692* (2013.01)

(56) References Cited

U.S. PATENT DOCUMENTS

| | | | | |
|---|---|---|---|---|
| 2015/0248078 | A1* | 9/2015 | Mugita ..... | G03G 15/0898<br>399/103 |
| 2016/0085178 | A1* | 3/2016 | Kawasumi ..... | G03G 15/0882<br>399/106 |
| 2016/0216639 | A1* | 7/2016 | Nose ..... | G03G 15/0886 |

FOREIGN PATENT DOCUMENTS

| | | | |
|---|---|---|---|
| JP | 2010-085970 | A | 4/2010 |
| JP | 2011-242639 | A | 12/2011 |
| JP | 2014-081665 | A | 5/2014 |

* cited by examiner

DEVELOPING APPARATUS HAVING A SEALING SHEET AND UNSEALING MECHANISM

BACKGROUND OF THE INVENTION

Field of the Invention

The present invention relates to a developing apparatus that develops an electrostatic image using developer that includes toner and a carrier.

Description of the Related Art

In an image forming apparatus that uses an electrophotographic system or an electrostatic recording system such as a copier, a printer, a facsimile apparatus or a multifunction peripheral that is equipped with these functions, a developing apparatus which uses a developer (two-component developer) that contains toner and a carrier as a developer is used.

In a developing apparatus that uses a two-component developer, as the toner is consumed in the development process, toner of an amount corresponding to the consumed amount of toner is supplied. In contrast, the carrier is neither consumed nor supplied, and remains inside the developing apparatus. Consequently, the carrier is agitated in the developing apparatus more frequently than the toner, and this situation tends to lead to a deterioration in the charging performance due to accumulation of external additives, adhesion of wax, and toner spent. As a result, if the charge amount of the toner is insufficient, image defects such as image density unevenness or fog in a white background may occur. Therefore, a method is available that replenishes the developing apparatus with developer tor replenishment in which a carrier particle is mixed with a toner particle at a predetermined ratio, and that also gradually discharges excessive developer within the developing apparatus to outside of the developing apparatus (Japanese Patent Application Laid-Open No. 2002-72686). According to this method, it is possible to replenish an amount of toner that corresponds to the consumed amount of toner into the developing apparatus, and to also gradually replace the carrier that deteriorated inside the developing apparatus with a new supply of the carrier.

Methods which are used for supplying the developer that is to foe first used (hereunder, also referred to as "initial developer") by the developing apparatus include a method in which the initial developer that had been stored in a separate container from the developing apparatus is supplied to the developing apparatus, and a method in which the initial developer is stored in advance in the developing apparatus. In the case of the method in which the initial developer is supplied to the developing apparatus from a separate container, there are problems such as that the developer overflows when the developer is being supplied, the developer causes stains, there is a loss of operating time, and the operability is affected. In recent years, because of a demand to shorten the installation time and simplify the installation procedures, the method in which the initial developer is stored in advance in the developing apparatus is becoming mainstream.

When the method in which the initial developer is stored in advance in the developing apparatus is adopted, the developer is sealed inside the developing apparatus to thereby prevent overflow and leakage of the developer during haulage (during physical distribution and during transportation) of the image forming apparatus or the developing apparatus. For example, an opening in a partition wall that partitions an agitating chamber and a developing chamber that form a circulation path for developer in the developing apparatus is sealed with a sealing member, and the developing apparatus is shipped in a state in which the initial developer is encapsulated in the agitating chamber (Japanese Patent Application Laid-open No. 2011-242639). Further, as another example, a space between a developer bearing member disposed in an opening of a developing chamber and the developing chamber is sealed with a sealing member, and the developing apparatus is shipped in a state in which the initial developer is encapsulated in the developing chamber and the agitating chamber (Japanese Patent Application Laid-open No. 2003-5517).

In a developing apparatus that gradually discharges developer, such as the developing apparatus described in Japanese Patent Application Laid-Open No. 2002-72686, a discharging port for the developer and a discharge passage for feeding the developer to the discharging port are provided. In many cases, a shutter or the like for preventing developer from being discharged in a state in which the developing apparatus has been taken out from the image forming apparatus is provided in the discharging port. The discharge passage is formed integrally with the developing chamber or the agitating chamber, or is connected to the developing chamber or the agitating chamber. Consequently, if a method in which the initial developer is stored in advance in the developing apparatus such as is described in Japanese Patent Application Laid-open No. 2011-242639 or in Japanese Patent Application Laid-Open No. 2003-5517 is adopted, there is a possibility that the initial developer may become unevenly distributed inside the developing apparatus during transportation of the image forming apparatus or the developing apparatus, and the initial developer may enter into the discharge passage.

As described in Japanese Patent Application Laid-Open No. 2011-242639 and in Japanese Patent Application Laid-Open No. 2003-5517, in a case where a sealing member is automatically unsealed in response to a driving input to a developing apparatus, in addition to uneven distribution of the developer occurring during transportation, in some cases uneven distribution of the developer also occurs temporarily from the time that driving of a feeding member is started until the surface level of the developer stabilizes. According to the configuration that encapsulates the initial developer only in the agitating chamber as described in Japanese Patent Application Laid-Open No. 2011-242639, the developer is liable to become unevenly distributed toward the downstream side in the feeding direction of the developer in the agitating chamber until a sealing member of a communication part that serves to transfer the developer from the agitating chamber to the developing chamber is unsealed. Consequently there is a risk that a large amount of developer will enter a discharge passage that is provided on the downstream side of the developer in the agitating chamber. Further, with regard to the configuration that encapsulates the initial developer in the developing chamber and the agitating chamber as described in Japanese Patent Application Laid-Open No. 2003-5517, in some cases the developer becomes unevenly distributed near an inlet part of the discharge passage during transportation. Therefore, the developer is liable to enter a discharge passage provided on the downstream side of the developing chamber or the agitating chamber simultaneously with the start of driving of a feeding member.

The developer that entered the discharge passage is fed to a discharging port, and is discharged from the discharging port. That is, when starting to use the developing apparatus at the time of initial installation of the image forming apparatus or when replacing the developing apparatus, initial developer that is unused and has not deteriorated is discharged from the discharging port. Therefore, there is a desire for a configuration that can reduce the discharge of unused initial developer and can efficiently use the initial developer.

SUMMARY OF THE INVENTION

An object of the present invention is, with respect to a developing apparatus in which a seal that is inside a developing container is unsealed upon receipt of a driving force, to provide a developing apparatus that can reduce the discharge of unused initial developer.

Another object of the present invention is to provide a developing apparatus mountable to an image forming apparatus, including: a developer bearing member bearing toner; a first chamber containing developer having the toner and a carrier; a second chamber containing the developer, and configured to form a circulation path of the developer in combination with the first chamber; a first feeding member arranged in the first chamber and feeding the developer inside the first chamber in a first direction; a second feeding member arranged in the second chamber and feeding the developer inside the second chamber in a second direction opposite to the first direction; a first communication part through which the developer is transferred from the first chamber to the second chamber; a second communication part through which the developer is transferred from the second chapter to the first chamber; a feeding path having a discharging port through which the developer is discharged, and communicating with the first chamber on a downstream side relative to the first communication part in the first direction to feed the developer toward the discharging port; a sealing part sealing the developer inside the developing apparatus before usage of the developing apparatus starts; a feeding path sealing part arranged in the sealing part, and sealing the feeding path on an upstream side relative to the discharging port in the first direction before usage of the developing apparatus starts; and an unsealing mechanism receiving a driving force frosts the image forming apparatus and unsealing the sealing part.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereunder, the developing apparatus according to the present invention is described in further detail in accordance with the accompanying drawings.

Embodiment 1

1. Image forming Apparatus

Figure 1:
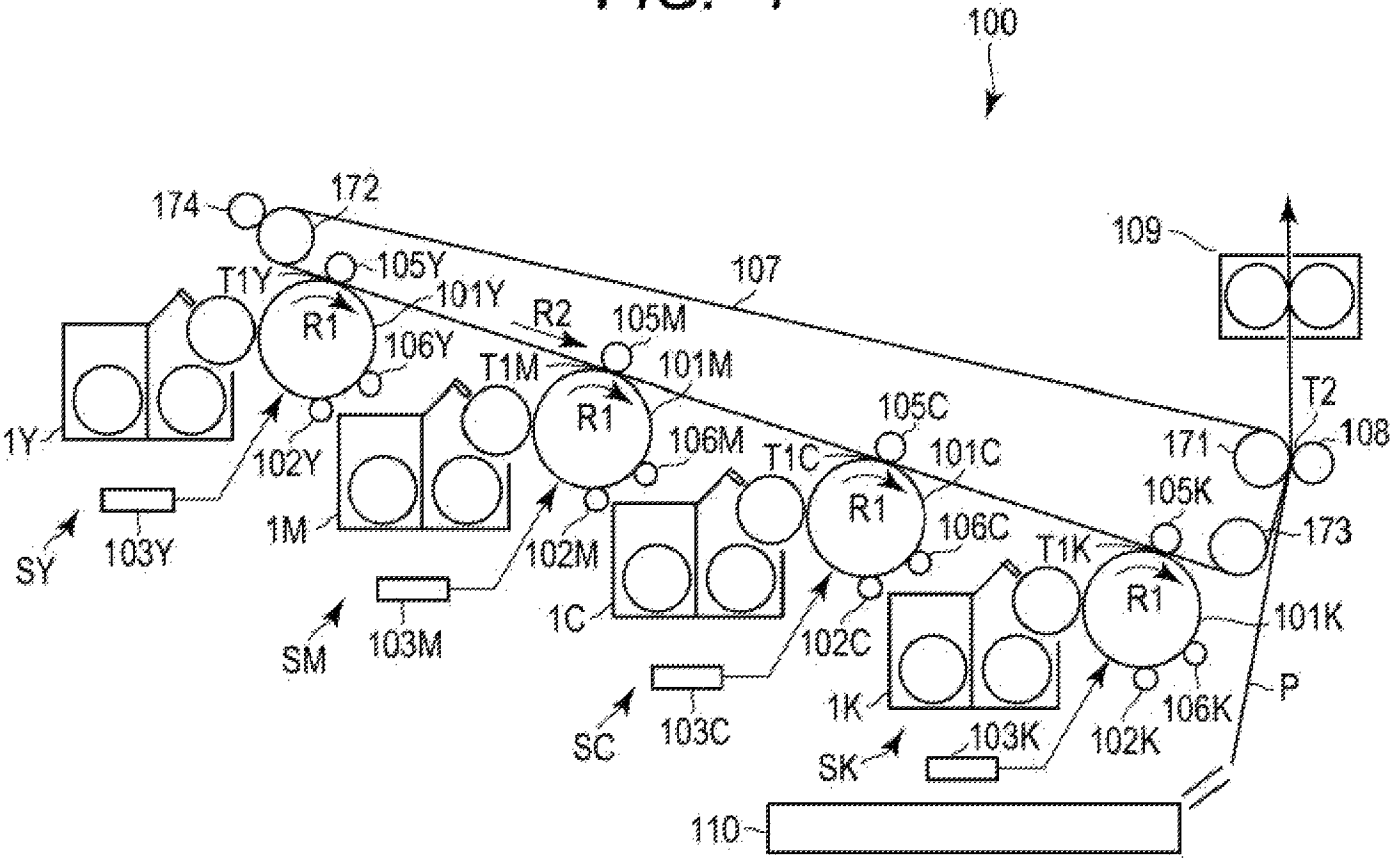
FIG. 1 is a schematic front cross-sectional view of an image forming apparatus.

FIG. 1 is a schematic front cross-sectional view of an Image forming apparatus 100 of the present embodiment. The image forming apparatus 100 of the present embodiment is a multifunction peripheral that has a combination of a copier function, a printer function and a facsimile function, and that forms a full-color image using an electrophotographic system. The image forming apparatus 100 has, as a plurality of image forming portions (image forming stations), a first image forming portion SY, a a second image forming portion SM, a third image forming portion SC, and a fourth image forming portion SK that form images in the colors yellow (Y), magenta (M), cyan (C) and black (K), respectively. In the present embodiment the configurations and operations of the respective image forming portions SY, SM, SC and SK are substantially the same except that the respective colors of toner used in a developing process are different to each other. Accordingly, when it is not necessary to particularly distinguish between elements of the four colors, the suffixes Y, M, C and K of the reference symbols that denote that a given element is for use with one of the colors are omitted, and the element in question is described in an overall manner. In the present embodiment, the image forming portion S includes a photosensitive drum 101, a charging roller 102, a developing apparatus 1, a primary transfer roller 105 and an auxiliary charging roller 106.

The photosensitive drum 101 is a drum-type (cylindrical) photosensitive member (electrophotographic photosensitive member) as an image bearing member. The photosensitive drum 101 is rotationally driven at a predetermined peripheral velocity (process speed) in an arrow R1 direction (clockwise) in FIG. 1 by a driving motor (not illustrated). The surface of the rotating photosensitive drum 101 is uniformly charged to a predetermined potential having a predetermined polarity by a charging roller 102 as a charging unit. The surface of the photosensitive drum 101 that was charged is subjected to scanning expose re in accordance with image information by an exposure apparatus (laser scanner) 103 as an exposing unit to thereby form an electrostatic image (electrostatic latent image) on the photosensitive drum 101. The electrostatic image that is formed on the photosensitive drum 101 is developed (visualized) using developer by the developing apparatus 1 as a developing unit to thereby form a toner image on the photosensitive drum 101. In the present embodiment, toner that was charged with the same polarity (negative polarity in the present embodiment) as the charge polarity of the photosensitive drum 101 adheres to the exposed portion on the photosensitive drum 101 at which the charge was removed (the absolute value of the potential decreased) as a result of being exposed after the photosensitive drum 101 was uniformly charged.

An intermediate transfer belt 107 constituted by an endless belt is arranged as an intermediate transfer member so as to face each of the photosensitive drums 101. The intermediate transfer belt 107 is suspended between and looped around a secondary transfer opposing roller 171, a tension roller 172 and an idler roller 173. The secondary transfer opposing roller 171 that also serves as a drive roller is rotationally driven by a driving motor (not illustrated). By this means, the intermediate transfer belt 107 rotates (circulatingly moves) at approximately the same velocity as the peripheral velocity of the photosensitive drum 101 in the arrow R2 direction in FIG. 1. Primary transfer rollers 105 as primary transfer units are arranged on the inner circumferential surface side of the intermediate transfer belt 107 so as to be at positions that correspond to the respective photosensitive drums 101. The primary transfer rollers 105 are pressed toward the photosensitive drums 101 and the intermediate transfer belt 107 therebetween to form primary transfer portions T1 where the photosensitive drums 101 and the intermediate transfer belt 107 are in contact with each other. A toner image formed on the photosensitive drum 101 is subjected to primary transfer onto the intermediate transfer belt 107 by the action of the primary transfer roller 105 at the primary transfer portion T1. For example, when forming a full-color image, four toner images in the different colors of yellow, magenta, cyan, and black, respectively, that were formed on the respective photosensitive drums 101 are subjected to primary transfer in sequence so as to be superposed on the intermediate transfer belt 107.

On the outer circumferential surface side of the intermediate transfer belt 107, a secondary transfer roller 108 as a secondary transfer unit is disposed at a position facing the secondary transfer opposing roller 171. The secondary transfer roller 108 is pressed toward the secondary transfer opposing roller 171 with the intermediate transfer belt 107 therebetween to form a secondary transfer portion T2 where the intermediate transfer belt 107 and the secondary transfer roller 108 are in contact with each other. By the action of the secondary transfer roller 108, a toner image formed on the intermediate transfer belt 107 is subjected to secondary transfer at the secondary transfer portion T2 onto a sheet (recording material) P such as a recording paper that is nipped and fed between the intermediate transfer belt 107 and the secondary transfer roller 108. The sheets P are stored in a stacked state in a storage cassette 110. After being sent out by a feeding and transport apparatus (not illustrated), the sheet P is fed to the secondary transfer portion T2 in a manner in which registration rollers (not illustrated) cause the timing of the sheet P to match the timing of the toner image on the intermediate transfer belt 107.

The sheet P onto which the toner image was secondarily transferred is heated and pressurized by a fixing apparatus 109 as a fixing unit to thereby fix the toner image to the surface of the sheet P. Thereafter, the sheet P is discharged onto a discharge tray (not illustrated) that is provided on the outside of the main body of the image forming apparatus 100.

Toner (primary transfer residual toner) that remains on the photosensitive drum 101 after the primary transfer is charged at the auxiliary charging roller 106 as an auxiliary charging unit and the charging roller 102, and thereafter is collected by the developing apparatus 1. On the outer circumferential surface side of the intermediate transfer belt 107, a belt cleaner 174 as an intermediate transfer member cleaning unit is arranged at a position facing the tension roller 172. Toner (secondary transfer residual toner) that remains on the intermediate transfer belt 107 after the secondary transfer is collected by the belt cleaner 174.

2. Basic Configuration of Developing Apparatus

Figure 2:
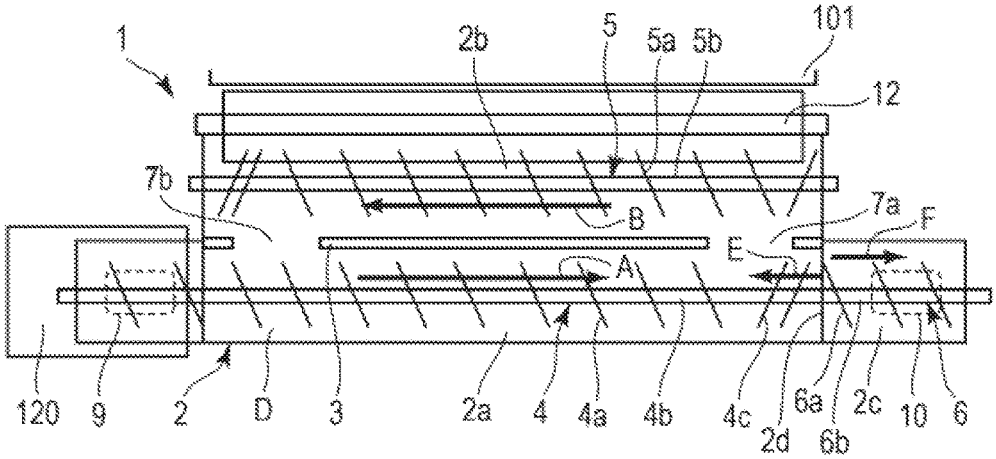
FIG. 2 is a schematic top cross-sectional view of a developing apparatus.

Next, the developing apparatus 1 will be described. FIG. 2 is a schematic top cross-sectional view of the developing apparatus 1 (the photosensitive drum 101 is also illustrated together therewith) of the present embodiment. The developing apparatus 1 has a developing container 2. The developing container 2 includes an agitating chamber 2*a* as a first chamber, and a developing chamber 2*b* as a second chamber. The agitating chamber 2*a* and the developing chamber 2*b* are defined so as to be approximately parallel to each other. The agitating chamber 2*a* and the developing chamber 2*b* are partitioned by a partition wall (first wall part) 3. A developer (two-component developer) D that includes toner (a non-magnetic toner particle) and a carrier (a magnetic carrier particle) is contained in the agitating chamber 2*a* and the developing chamber 2*b*. The longitudinal direction of the partition wall 3 is approximately parallel to the rotation axis direction of the photosensitive drum 101. The longitudinal direction of each of the agitating chamber 2*a* and the developing chamber 2*b* is approximately parallel to the rotation axis direction of the photosensitive drum 101.

The agitating chamber 2*a* and the developing chamber 2*b* form a circulation path of the developer D. That is, a first communication part 7*a* that is an opening that enables transfer of the developer D from the agitating chamber 2*a* to the developing chamber 2*b* is provided in the vicinity of one end (end on the right side in FIG. 2) in the longitudinal direction of the partition wall 3. A second communication part 7*b* that is an opening that enables transfer of the developer D from the developing chamber 2*b* to the agitating chamber 2*a* is provided in the vicinity of the other end (and on the left side in FIG. 2) in the longitudinal direction of the partition wall 3. The agitating chamber 2*a* and the developing chamber 2*b* communicate through the first communication part 7*a* and the second communication part 7*b*.

A first screw 4 as a first feeding member is provided inside the agitating chamber 2*a*. The first screw 4 is rotatably attached to the developing container 2. The first screw 4 includes, around a first rotary shaft 4*b* as a shaft member, a forward feeding part 4*a* that is constituted by a screw blade as a first feeding part, and a reverse feeding part 4*c* that is constituted by a screw blade as a second feeding part. The rotation axis direction of the first rotary shaft 4*b* is approximately parallel to the rotation axis direction, of the photosensitive drum 101. The forward feeding part 4*a* rotates integrally with the first rotary shaft 4*b*. By this means, the first screw 4 feeds the developer D which is inside the agitating chamber 2*a* in the direction (hereunder, also referred to as "first feeding direction A") from the second communication part 7*b* toward the first communication part 7*a* as indicated by an arrow A in FIG. 2. The reverse feeding part 4*c* will be described later. A second screw 5 as a second feeding member is provided inside the developing chamber 2*b*. The second screw 5 is rotatably attached to the developing container 2. The second screw 5 includes, around a second rotary shaft 5*b*, a feeding part 5*a* that is constituted by a screw blade. The rotation axis direction of the second rotary shaft 5*b* is approximately parallel to the rotation axis direction of the photosensitive drum 101. The feeding part 5*a* rotates integrally with the second rotary shaft 5*b*. By this means, the second screw 5 feeds the developer D which is inside the developing chamber 2*b* in the direction (hereunder, also referred to as "second feeding direction B") from the first communication part 7*a* toward the second communication part 7*b* as indicated by an arrow B in FIG. 2.

The developer D is fed through the inside of the agitating chamber 1*a* in the first feeding direction A (first direction) and transferred to the developing chamber 2*b* through the first communication part 7*a*. The developer D is then fed through the inside or the developing chamber 2*b* in the second feeding direction B (second direction) and transferred to the agitating chamber 2*a* through the second communication part 7*b*. The developer D contained in the developing container 2 is circulated through the inside of the developing container 2 along the above described circulation path. The developer D inside the developing container 2 is agitated in the course of being fed, and in the present embodiment the toner is charged by friction with a negative polarity and the carrier is charged by friction with a positive polarity, and the toner adheres to the carrier.

In the image forming apparatus 100, a developer replenishing mechanism 120 is provided upward of the agitating chamber 2*a* that is extended further to the upstream side than the second communication part 7*b* in the first feeding direction A. Developer for replenishment that is contained in a replenishment developer container (not illustrated) that is detachably mounted to the main body of the image forming apparatus 100 is fed to the developer replenishing mechanism 120 along a feeding passage (not illustrated). The developer replenishing mechanism 120 causes developer for replenishment to fall down into the agitating chamber 2*a* through a replenishment port 9 that is an opening provided in an upper wall of the agitating chamber 2*a* to thereby replenish the toner. In the developing apparatus 1, a replenishment port shutter (not illustrated) is provided for blocking the replenishment port 9 in a state in which the developing apparatus 1 has been detached from the main body of the image forming apparatus 100.

Figure 3:
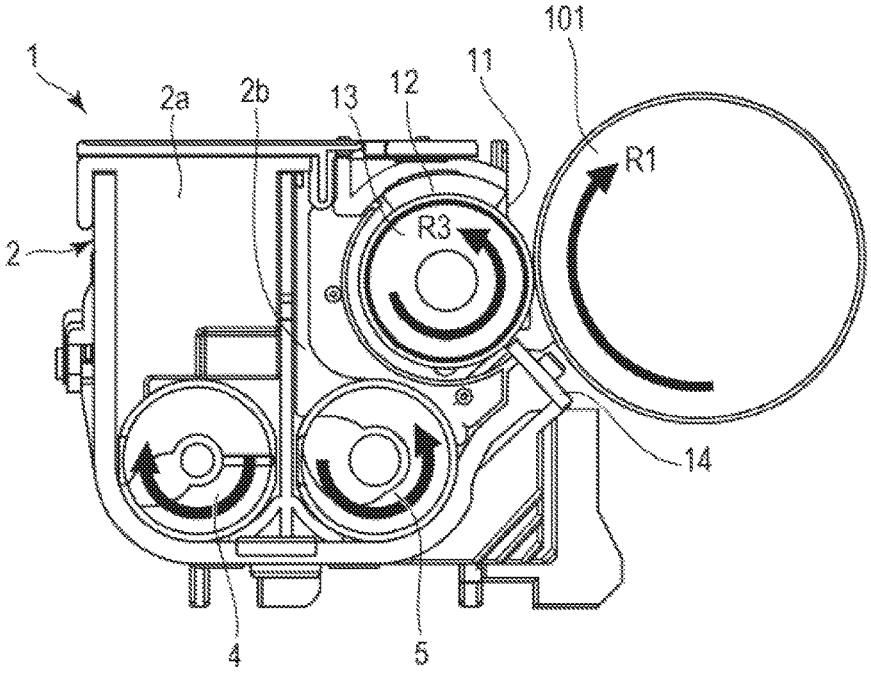
FIG. 3 is a front cross-sectional view of the developing apparatus.

FIG. 3 is a front cross-sectional view of the developing apparatus 1 of the present embodiment (the photosensitive drum 101 is also illustrated; illustration of first and second sealing sheets and a wind-up shaft is omitted). In the developing chamber 2*b*, a developer opening part 11 that is an opening is provided at a position opposing the photosensitive drum 101. In the developing chamber 2*b*, a developing sleeve 12 having a hollow cylindrical shape that is formed of a non-magnetic material is disposed as a developer bearing member in a manner so that one portion thereof is exposed to outside from the developer opening part 11. The developing sleeve 12 is rotatably attached to the developing container 2. The developing sleeve 12 is rotationally driven in an arrow R3 direction in FIG. 3 (direction in which the surface of the photosensitive drum 101 and the surface of the developing sleeve 12 move in the forward direction at the opposing portion between the photosensitive drum 101 and the developing sleeve 12). The rotation axis direction of the developing sleeve 12 is approximately parallel to the rotation axis direction of the photosensitive drum 101. A magnet roller 13 as a magnetic field generating unit is disposed inside (in the hollow part of) the developing sleeve 12. The magnet roller 13 is fixed to the developing container 2 so as not to rotate. The magnet roller 13 has a plurality of magnetic poles in the circumferential direction.

The developer D inside the developing chamber 2*b* is supplied to the developing sleeve 12 in the coarse of being fed by the second screw 5. A predetermined amount of the developer D supplied to the developing sleeve 12 is borne on the developing sleeve 12 by a magnetic field that the magnet roller 13 generates, to thereby form a developer reservoir. By rotation of the developing sleeve 12, the amount (layer thickness) of the developer D on the developing sleeve 12 is regulated by a developing blade 14 as a regulating member that passes through the developer reservoir. Thereafter, the developer D on the developing sleeve 12 is fed to a developing region that faces the photosensitive drum 101. In the developing region, the developer D on the developing sleeve 12 is caused to form magnetic bead chains by the magnetic field that the magnet roller 13 generates, to thereby form magnetic bristles. In the present embodiment, the developing apparatus 1 causes the magnetic bristles to come in contact with the photosensitive drum 101 to thereby supply toner contained in the developer D to an electrostatic image on the photosensitive drum 101. In order to improve the development efficiency, that is, to increase the percentage of toner imparted to the electrostatic image, a development bias voltage in which a direct-current voltage and an alternating current voltage are superimposed is applied to the developing sleeve 12 from a development bias power source 111 (FIG. 4) as a voltage applying unit. The developer D remaining on the developing sleeve 12 after the toner is supplied to the electrostatic image on the photosensitive drum 101 is returned to the developing chamber 2*b* by further rotation of the developing sleeve 12.

Figure 4:
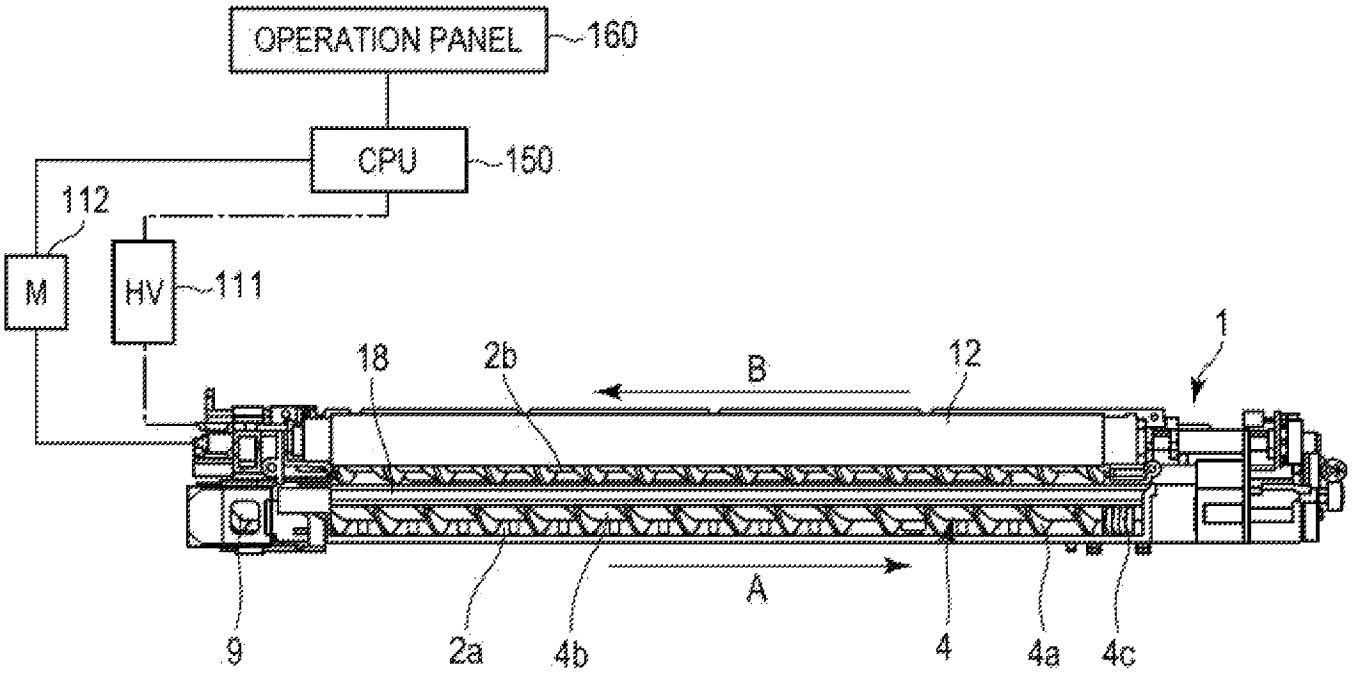
FIG. 4 is a schematic diagram illustrating the driving configuration of the developing apparatus.

FIG. 4 is a schematic diagram illustrating the driving configuration, voltage application configuration and control configuration of the developing apparatus 1 of the present embodiment, which illustrates a state in which the inside of the developing container 2 is viewed from an upper part of the developing apparatus 1. The image forming apparatus 100 includes a driving motor 112 as a driving source that generates a driving force to be input to the developing apparatus 1, and a drive transmission member (not illustrated) that transmits the driving force from the driving motor 112 to the developing apparatus 1. Further, the image forming apparatus 100 has a development bias power source (high voltage power supply circuit) 111 that applies a development bias voltage to the developing sleeve 12. The image forming apparatus 100 includes a CPU 150 as a control unit that performs overall control of the operations of each part of the image forming apparatus 100, including the driving motor 112 and the development bias power source 111. The image forming apparatus 100 also includes an operation panel 160 as an operation portion for inputting to the CPU 150 an instruction to start a driving input to the developing apparatus 1 when initially installing the image forming apparatus 100 and when replacing the developing apparatus 1.

3. Developer Discharging Configuration

Figure 5B:
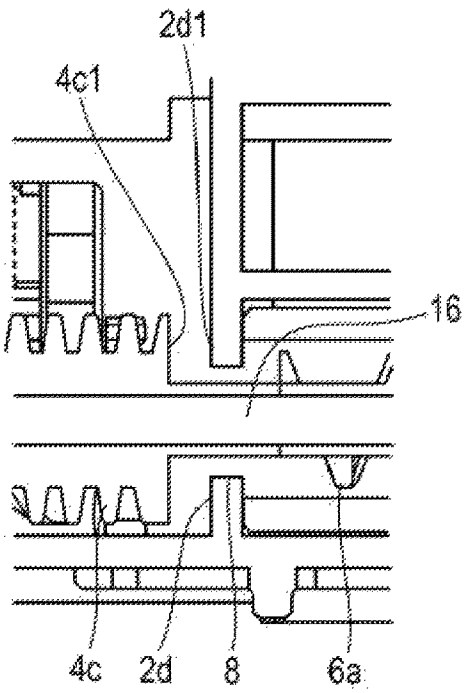
FIG. 5B is a partially enlarged cross-sectional view of FIG. 5A.
Figure 5A:
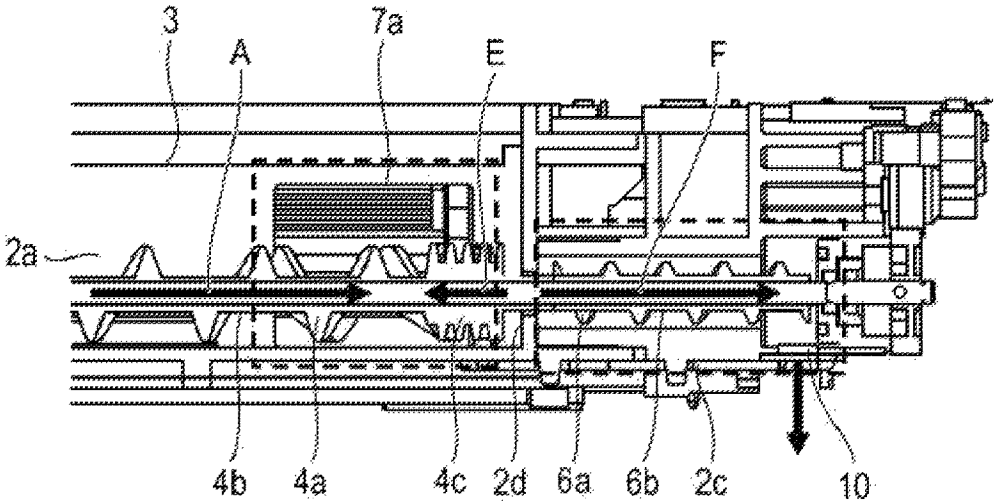
FIG. 5A is a side cross-sectional view of the developing apparatus in the vicinity of a discharge passage.

Next, the configuration for discharging the developer D will be described. FIG. 5A is a side cross-sectional view of the developing apparatus 1 taken along a plane that includes the rotation axis of the first screw 4, in which the vicinity of the downstream side end in the first feeding direction A is illustrated. FIG. 5B is an enlarged cross-sectional view of a part of FIG. 5A.

The developing container 2 has a discharge passage 2*c* (feeding path) as a third chamber that accepts the developer D that moved from the agitating chamber 2*a* to outside of the circulation path of the developer D. The discharge passage 2*c* is disposed in a continuous manner on the downstream side of the agitating chamber 2*a* in the first feeding direction A. At a connecting portion between the agitating chamber 2*a* and the discharge passage 2*c*, a side wall (second wall part) 2*d* is provided that holds back the developer D. That is, the agitating chamber 2*a* and the discharge passage 2*c* are partitioned by the side wall 2*d* (a difference in level). An inlet part 8 that is an opening that enables movement of the developer D from the agitating chamber 2*a* to the discharge passage 2*c* is provided in the side wall 2*d*. The agitating chamber 2*a* and the discharge passage 2*c* communicate through the inlet part 8. The inlet part 8 is disposed on the downstream side of the reverse feeding part 4*c* of the first screw 4 in the first feeding direction A.

A third screw 6 as a third feeding member is provided inside the discharge passage 2*c*. The third screw 6 is rotatably attached to the developing container 2. The third screw 6 has a discharge feeding part 6*a* constituted by a screw blade as a third feeding part around a third rotary shaft 6*b* as a shaft member. The rotation axis direction of the third rotary shaft 6*b* is approximately parallel to the rotation axis direction of the photosensitive drum 101. The discharge feeding part 6*a* rotates integrally with the third rotary shaft 6*b*. By this means, the third screw 6 feeds the developer D inside the discharge passage 2*c* in a direction (hereunder, also referred to as "third feeding direction F") away from the inlet part 8 and towards a discharging port 10 as indicated by an arrow F in FIG. 5A. In the present embodiment, the third screw 6 is disposed on the same axis as the first screw 4. In particular, in the present embodiment the third rotary shaft 6*b* of the third screw 6 and the first rotary shaft 4*b* of the first screw 4 are integrally formed, and a shaft part 16 that connects the third rotary shaft 6*b* and the first rotary shaft 4*b* passes through the inlet part 8.

In the present embodiment, at least one portion of a shaft member integrally constituting the first rotary shaft 4*b*, the third rotary shaft 6*b* and the shaft part 16 is disposed in the agitating chamber 2*a*. The forward feeding part 4*a* and the reverse feeding part 4*c* are provided at the portion of the shaft member that is disposed in the agitating chamber 2*a*. Further, in the present embodiment, at least one portion of the shaft member integrally constituting the first rotary shaft 4*b*, the third rotary shaft 6*b* and the shaft part 16 passes through the inlet part 8 to be disposed in the discharge passage 2*c*. The discharge feeding part 6*a* is provided in the portion of the shaft member that is disposed in the discharge passage 2*c*.

The reverse feeding part 4*c* is provided around the first rotary shaft 4*b* on the first screw 4. The reverse feeding part 4*c* is disposed on the downstream side of the forward feeding part 4*a* in the first feeding direction A. The reverse feeding part 4*c* rotates integrally with the first rotary shaft 4*b* to thereby feed the developer D that is inside the agitating chamber 2*a* in the reverse direction (hereunder, also referred to as "reverse feeding direction E") to the feeding direction of the forward feeding part 4*a*, as indicated by an arrow E in FIG. 5A. That is, in the vicinity of the connecting portion between the discharge passage 2*c* and the agitating chamber 2*a* at the downstream side end of the agitating chamber 2*a* in the first feeding direction A, the reverse feeding part 4*c* pushes back the developer D in the reverse feeding direction E that is the opposite direction to the first feeding direction. When the first screw 4 rotates, the developer D that is inside the agitating chamber 2*a* is fed in the first feeding direction A toward the side wall 2*d*, and pressure is applied by excess developer D to the downstream side end of the agitating chamber 2*a* in the first feeding direction A. Further, excess developer D that exceeds a push-back force of the reverse feeding part 4*c* advances further downstream in the first feeding direction A and passes through the inlet part 8 and flows into the discharge passage 2*c*.

The discharging port 10 that is an opening is provided in the discharge passage 2*c* as a discharging part that enables discharge of the developer D to outside of the developing apparatus 1 from the discharge passage 2*c*. The discharging port 10 is arranged in the vicinity of the downstream side end of the discharge passage 2*c* in the third feeding direction F, and opens in the vertically downward direction. The developer D that moved from the agitating chamber 2*a* to the discharge passage 2*c* through the inlet part 8 is fed by the third screw 6 toward the discharging port 10. The discharging port 10 is connected to a collection passage (not illustrated) provided in the image forming apparatus 100. The developer D that was discharged from the discharging port 10 is fed via the collection passage to a collection chamber (not illustrated) that is detachably mounted to the main body of the image forming apparatus 100.

Figure 6:
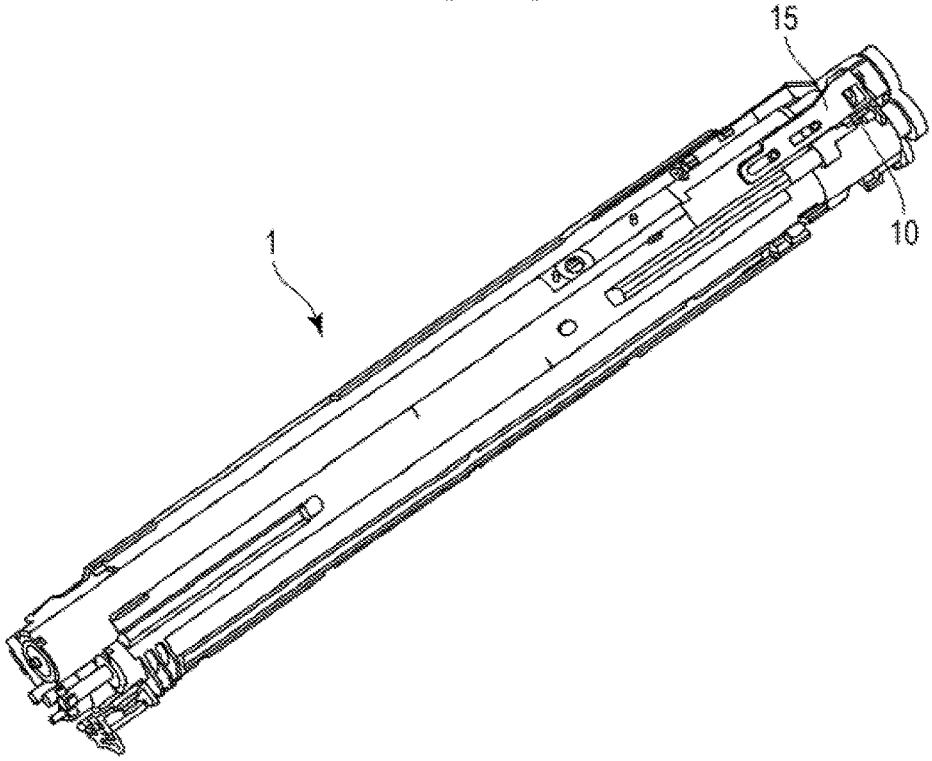
FIG. 6 is an external perspective view illustrating the bottom face of the developing apparatus.

FIG. 6 is an external perspective view that illustrates the bottom face of the developing apparatus 1. In the developing apparatus 1, a discharging port shutter 15 is provided for blocking the discharging port 10 in a state in which the developing apparatus 1 has been detached from the main body of the image forming apparatus 100.

4. Developer Discharging Operation

Figure 7A:
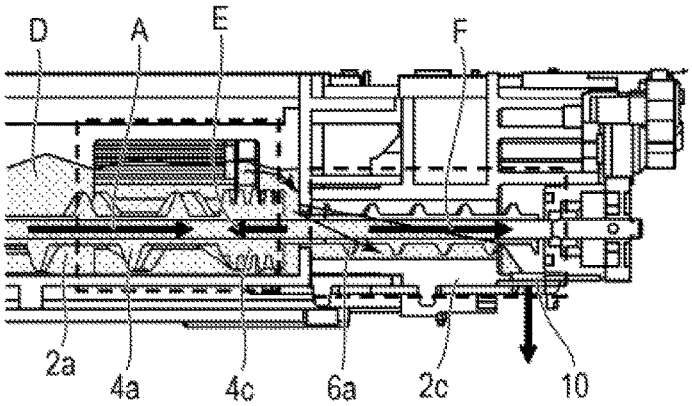
FIG. 7A is a side cross-sectional view of the developing apparatus for describing an operation to discharge developer, that illustrates a case where the volume of the developer increased.
Figure 7B:
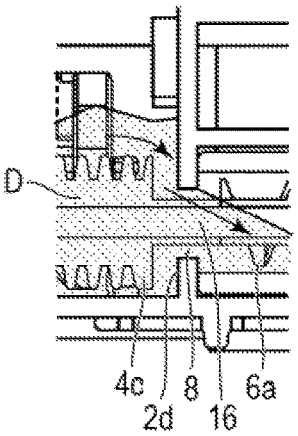
FIG. 7B is a partially enlarged view of FIG. 7A.
Figure 7C:
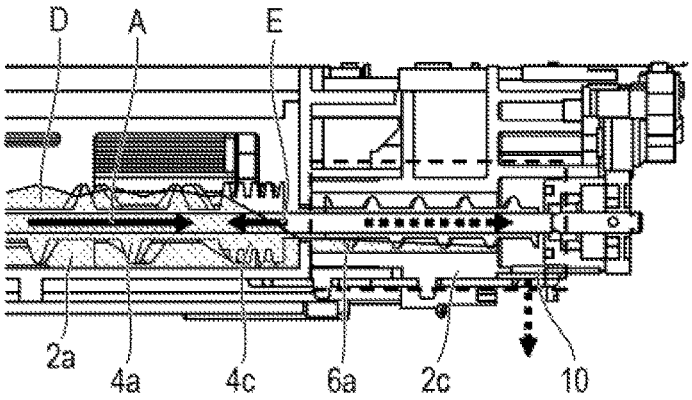
FIG. 7C is a side cross-sectional view of the developing apparatus for describing an operation to discharge developer, that illustrates a case where the volume of the developer decreased.
Figure 7D:
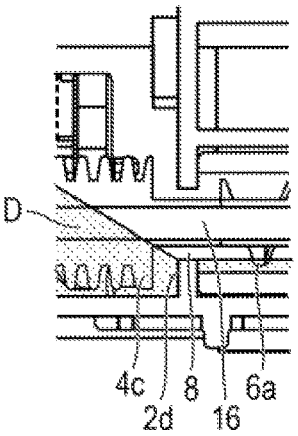
FIG. 7D is a partially enlarged view of FIG. 7C.

Next, an operation for discharging the developer D will be described. FIGS. 7A to 7D are side cross-sectional views of the developing apparatus 1 taken along a plane that includes the rotation axis of the first screw 4, which illustrate states of the developer D in the vicinity of the downstream side end in the first feeding direction A. FIG. 7A illustrates a case where the volume of the developer D increased, and FIG. 7B is an enlarged view of one part of FIG. 7A. FIG. 7C illustrates a case where the volume of the developer D decreased, and FIG. 7D is an enlarged view of one part of FIG. 7C.

The developer D that is inside the developing container 2 is circulated between the downstream side end in the first feeding direction A of the agitating chamber 2*a* and the downstream side end in the second feeding direction B of the developing chamber 2*b* while the feeding direction is being switched by 180°. When the volume of the developer D inside the developing container 2 increases, as illustrated in FIG. 7A, excess developer D that exceeds a push-back force of the reverse feeding part 4*c* passes over the reverse feeding part 4*c*. Subsequently, as illustrated in FIG. 7B, the developer D that passed over the reverse feeding pert 4*c* flows into the discharge passage 2*c* through the inlet part 8. The developer D that flowed into the discharge passage 2*c* is fed toward the discharging port 10 by the third screw 6, and is discharged to outside of the developing apparatus 1 from the discharging port 10. As a result, an increase in the height of the surface level of the developer D and an increase in the volume of the developer D inside the developing container 2 are saturated at approximately predetermined maximum values.

In a case where a state continues in which there is little or no replenishing of the developer D into the developing container 2, discharging the developer D leads to a gradual decrease in the volume of the developer D inside the developing container 2, and the height of the surface level of the developer D also decreases. When the volume of the developer D decreases to a certain degree and the height of the surface level of the developer D decreases, as illustrated in FIG. 7C, that amount of the developer D that is pushed back by the reverse feeding part 4*c* becomes relatively large in comparison to the amount of the developer D that is fed by the forward feeding part 4*a*. Therefore, as illustrated in FIG. 7D, excess developer D can no longer pass over the reverse feeding part 4*c*. Further, the developer D no longer passes through the inlet part 8 to flow into the discharge passage 2*c*, and discharge of the developer D from the discharging pert 10 stops. As a result, a decrease in the height of the surface level of the developer D and a decrease in volume of the developer D inside the developing container 2 are saturated at approximately predetermined minimum values. Thus, the volume of the developer D inside the developing apparatus 1 stabilizes in a fixed range.

5. Developer

Next, the developer D will be described. In the present embodiment, the developer D in the developing apparatus 1 is two-component developer in which toner and a carrier are mixed at a predetermined ratio. The mixing ratio between the toner and the carrier of the developer D in the developing apparatus 1 is, by weight ratio, toner:carrier=1:9 approximately. Here, in the developer (two-component developer) D that includes the toner and the carrier, there is a correlation between the charge amount of the toner and the weight proportion of the toner in the developer D (hereunder, also referred to as "T/D ratio"). Because the toner is charged by means of friction with the carrier, the charge amount of the toner increases as the opportunities for contact with the carrier increase. That is, the smaller that the T/D ratio is, the greater the charge amount of the toner will be. Therefore, the mixing ratio between the toner and the carrier of the developer D inside the developing apparatus 1 is set so that the proportion of the carrier is higher than the proportion of the toner so that a stable charge amount of the toner is obtained. The mixing ratio is not limited to the numerical values described in the present embodiment, and is to be suitably adjusted in accordance with the charge amount of the toner, the particle size of the carrier and the configuration of the image forming apparatus.

When image formation is executed in the image forming apparatus 100, only toner is consumed from inside the developing apparatus 1, and the T/D ratio for the developer D inside the developing apparatus 1 decreases. To stabilize the properties of the developer D it is necessary to replenish an amount of toner that corresponds to the amount of consumed toner to thereby maintain the T/D ratio of the developer D inside the developing container 2 at an approximately constant value. Toner of only an amount that corresponds to the consumed amount can be replenished to keep the T/D ratio approximately constant. However, in the present embodiment, two-component developer in which the toner and the carrier are mixed at a predetermined ratio is replenished as the developer for replenishment into the developing apparatus 1. The mixing ratio between the toner and the carrier of the developer for replenishment is, by weight ratio, toner:carrier=9:1 approximately. That is, in the present embodiment, the developer for replenishment is a two-component developer including a carrier particle at a lower proportion than a toner particle. Consequently, when this developer for replenishment is replenished into the developing apparatus 1, the volume of the developer D inside the developing apparatus 1 increases by an amount corresponding to the carrier particle that was replenished. When the volume of the developer D increases, the developer D is discharged from the discharging port 10 so that the volume of the developer D inside the developing apparatus 1 is in a fixed range, by means of the discharging configuration of the developer D. In the present embodiment, the same kind of toner and the same kind of carrier are used for both the initial developer and the developer for replenishment.

In the present embodiment, while a new carrier particle is being supplied in small amounts at a time into the developing apparatus 1 by replenishing the developer, old developer that had been contained in the developing apparatus 1 is discharged to thereby also discharge a deteriorated carrier particle in small amounts at a time. By this means, an old carrier particle is gradually replaced with the new carrier particle, and in this way progress of deterioration of the carrier particle is apparently stopped, and the properties of the developer overall are stable. As a result, it is not necessary to perform work to replace the developer D inside the developing apparatus 1, and it is possible to prolong the lifetime of the developing apparatus 1.

6. Initial Developer Encapsulation Configuration

Figure 8:
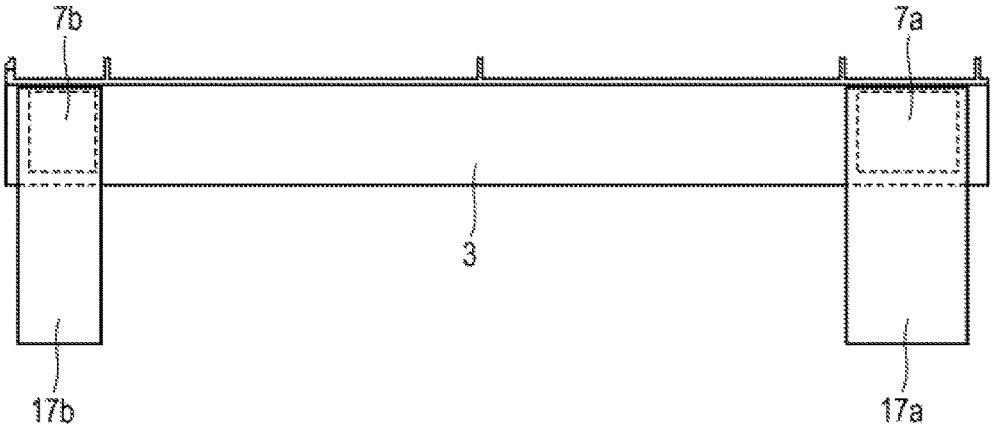
FIG. 8 is a perspective view of a component state of a partition wall.
Figure 9:
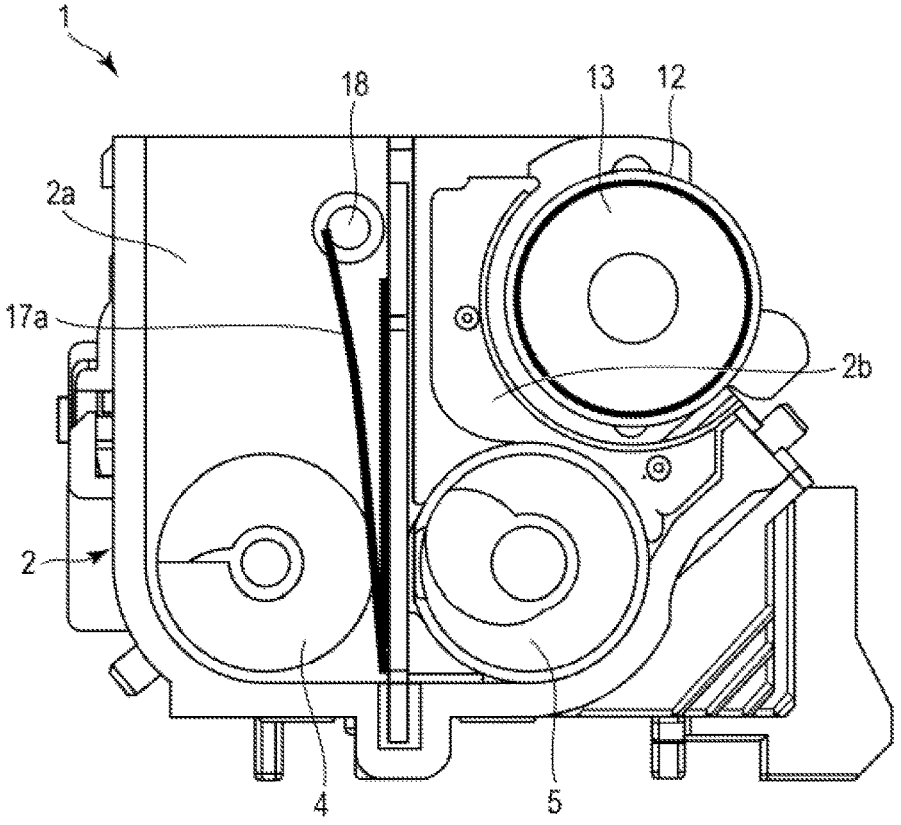
FIG. 9 is a front cross-sectional view of the developing apparatus in a state in which a sealing sheet is attached.

Next, the configuration for encapsulating (a sealing part) the initial developer D according to the present embodiment will be described. FIG. 8 is a perspective view illustrating a partition wall 3 in a component state in which a first sealing sheet 17*a* and a second sealing sheet 17*b* are affixed thereto. FIG. 9 is a front cross-sectional view of the developing apparatus 1 in a state in which the first sealing sheet 17*a* and the second sealing sheet 17*b* are affixed thereto.

In the present embodiment, the developing apparatus 1 has the first sealing sheet 17*a* as a first communication part sealing member that seals the first communication part 7*a*. Further, in the present embodiment, the developing apparatus 1 has the second sealing sheet 17*b* as a second communication part sealing member that seals the second communication part 7*b*. The first sealing sheet 17*a* and the second sealing sheet 17*b* are each band-like sheet members that are long in one direction. The vicinity of one end in the longitudinal direction of each of the first sealing sheet 17*a* and the second sealing sheet 17*b* is affixed in an unsealable manner (manner in which the sealing sheet can be stripped off) from the agitating chamber 2*a* side to the partition wall 3 around the first communication part 7*a* and the second communication part 7*b*, respectively. Further, the developing apparatus 1 has a wind-up shaft 18 as a wind-up member. The wind-up shaft 18 is rotatably attached to the developing container 2 at an upper part of the agitating chamber 2*a*. The rotation axis direction of the wind-up shaft 18 is approximately parallel to the rotation axis direction of the photosensitive drum 101.

One end in the longitudinal direction of each of the first sealing sheet 17*a* and the second sealing sheet 17*b* is affixed from the upper end side toward the lower end side of the first communication part 7*a* and the second communication part 7*b*, respectively. Further, the first sealing sheet 17*a* and the second sealing sheet 17*b* are folded back in the upward direction from the lower end side of the first communication part 7*a* and the second communication part 7*b*, respectively, and the other end in the longitudinal direction of each of the first sealing sheet 17*a* and the second sealing sheet 17*b* is fixed to the common wind-up shaft 18.

Figure 10B:
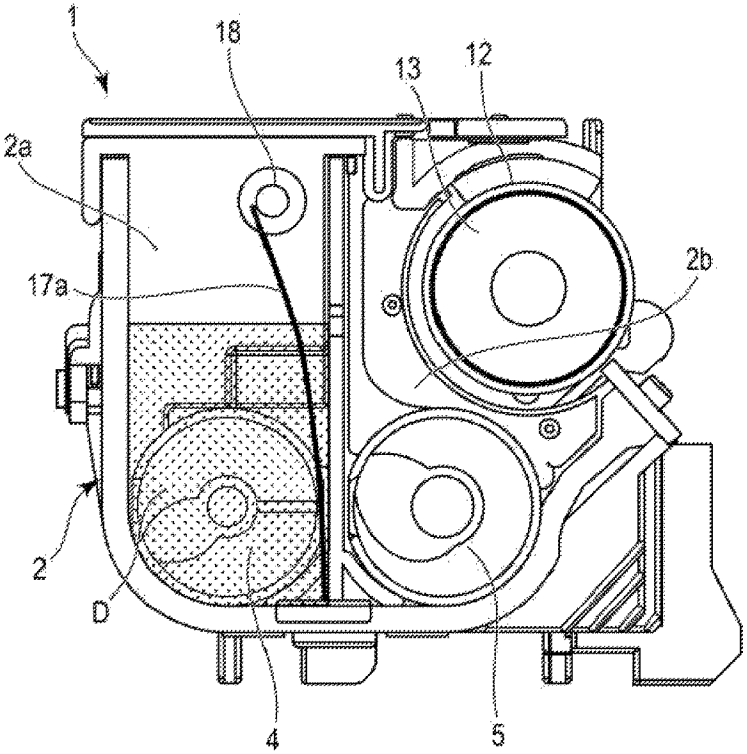
FIG. 10B is a front cross-sectional view of the developing apparatus for describing the height of the surface level of developer at the time of shipment.

At the time of shipment (before starting usage) of the developing apparatus 1, the initial developer D is filled into only the agitating chamber 2*a* in a state in which the first communication part 7*a* and the second communication part 7*b* are sealed by the first sealing sheet 17*a* and the second sealing sheet 17*b*, respectively (see FIG. 10B). At this time, there is neither any carrier nor any toner in the developing chamber 2*b*. Subsequently, when the developing apparatus 1 is driven for the first time when initially installing the image forming apparatus 100 or when replacing the developing apparatus 1, the wind-up shaft 18 is caused to rotate to thereby wind up the first sealing sheet 17*a* and the second sealing sheet 17*b* around the wind-up shaft 18. By this means, the first sealing sheet 17*a* and the second sealing sheet 17*b* are stripped off from the partition wall 3 surrounding the first communication part 7*a* and the second communication part 7*b* to thereby unseal the first communication part 7*a* and the second communication part 7*b*. As a result, the first communication part 7*a* and the second communication part 7*b* are opened and the agitating chamber 2*a* and the developing chamber 2*b* communicate through the first communication part 7*a* and the second communication part 7*b* (sea FIG. 10A).

7. Discharge Passage Sealing Configuration

Figure 10A:
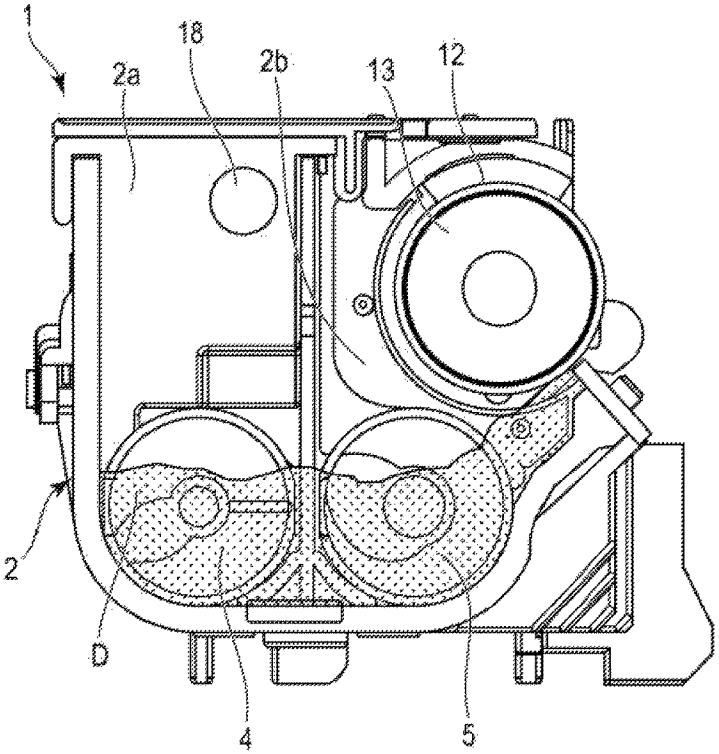
FIG. 10A is a front cross-sectional view of the developing apparatus for describing the height of the surface level of developer in a steady state.

Next, the configuration for sealing the inlet part 8 of the discharge passage 2*c* will be described. FIG. 10A is a front cross-sectional view of the developing apparatus 1 that illustrates the height of the surface level of the developer D inside the developing apparatus 1 in a steady state after use of the developing apparatus 1 was started. FIG. 10B is a front cross-sectional view of the developing apparatus 1 that illustrates the height of the surface level of the initial developer D inside the developing apparatus 1 at the time of shipment.

As illustrated in FIG. 10A, in a steady state after use of the developing apparatus 1 was started, the developer D inside the developing apparatus 1 circulates through the agitating chamber 2*a* and the developing chamber 2*b*. However, in the developing apparatus 1 at the time of shipment, the initial developer D that is of approximately the same amount as the developer D that circulates as described above is filled in only the agitating chamber 2*a*. Therefore, as illustrated in FIG. 10B, the surface level of the initial developer D in the agitating chamber of the developing apparatus 1 at the time of shipment reaches a higher position than the height of the surface level of the developer D inside the agitating chamber when circulating in the steady state as illustrated in FIG. 10A. As a result, due to uneven distribution of the initial developer D inside the agitating chamber 2*a* that is caused by rocking or inclination of the image forming apparatus 100 or the developing apparatus 1 during transportation, the initial developer D is liable to pass over the reverse feeding part 4*c* of the first screw 4 and enter the discharge passage 2*c* (see FIG. 7A). In the present embodiment, the first screw 4 is driven in conjunction with automatic unsealing of the first sealing sheet 17*a* and the second sealing sheet 17*b* when starting use of the developing apparatus 1. Therefore, it becomes easy for the initial developer D that is inside the agitating chamber 2*a* to become unevenly distributed toward the downstream side in the first feeding direction A, and to also pass over the reverse feeding part 4*c* and enter the discharge passage 2*c* by the time the first sealing sheet 17*a* has been unsealed.

In a case where the developing apparatus 1 has been detached from the main body of the image forming apparatus 100, and also before the image forming apparatus 100 is installed, leakage of the developer D from the discharging port 10 is prevented by the discharging port shutter 15 and by the seal members that are further provided. However, once the initial developer D has entered the discharge passage 2*c* during transportation or when starting usage of the image forming apparatus 100, the initial developer D does not return to the circulation path of the developer D formed by the agitating chamber 2*a* and the developing chamber 2*b*, and is fed by the third screw 6 and discharged from the discharging port 10. In a case where the amount of the initial developer D that is discharged is large, there is a possibility that the volume of the developer D at the initial stage of usage of the developing apparatus 1 will be insufficient and a problem such as image defects will arise.

Therefore, in the present embodiment, as a sealing member (feeding path sealing part) that seals the inlet part 8 of the discharge passage 2*c*, a sealing tape 20 that is described hereunder is provided between the reverse feeding part 4*c* of the first screw 4 and the side wall 2*d* that partitions the agitating chamber 2*a* and the discharge passage 2*c* in the developing apparatus 1.

Figure 11B:
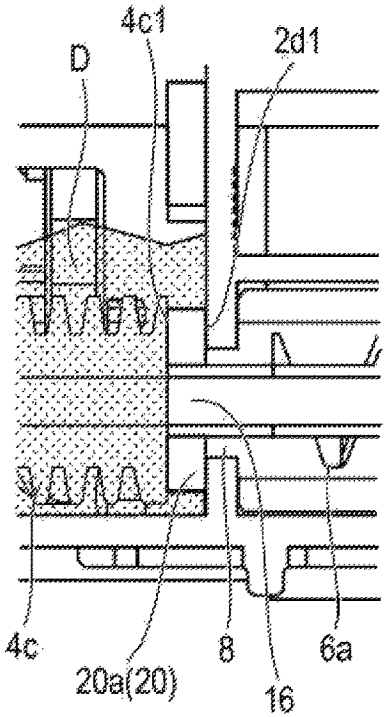
FIG. 11B is a partially enlarged view of FIG. 11A.
Figure 11A:
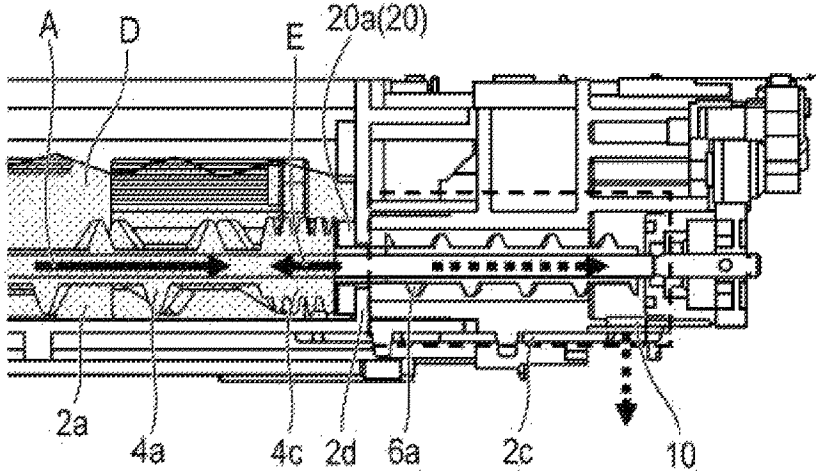
FIG. 11A is a side cross-sectional view of the developing apparatus in a state in which a sealing tape is attached.
Figure 12:
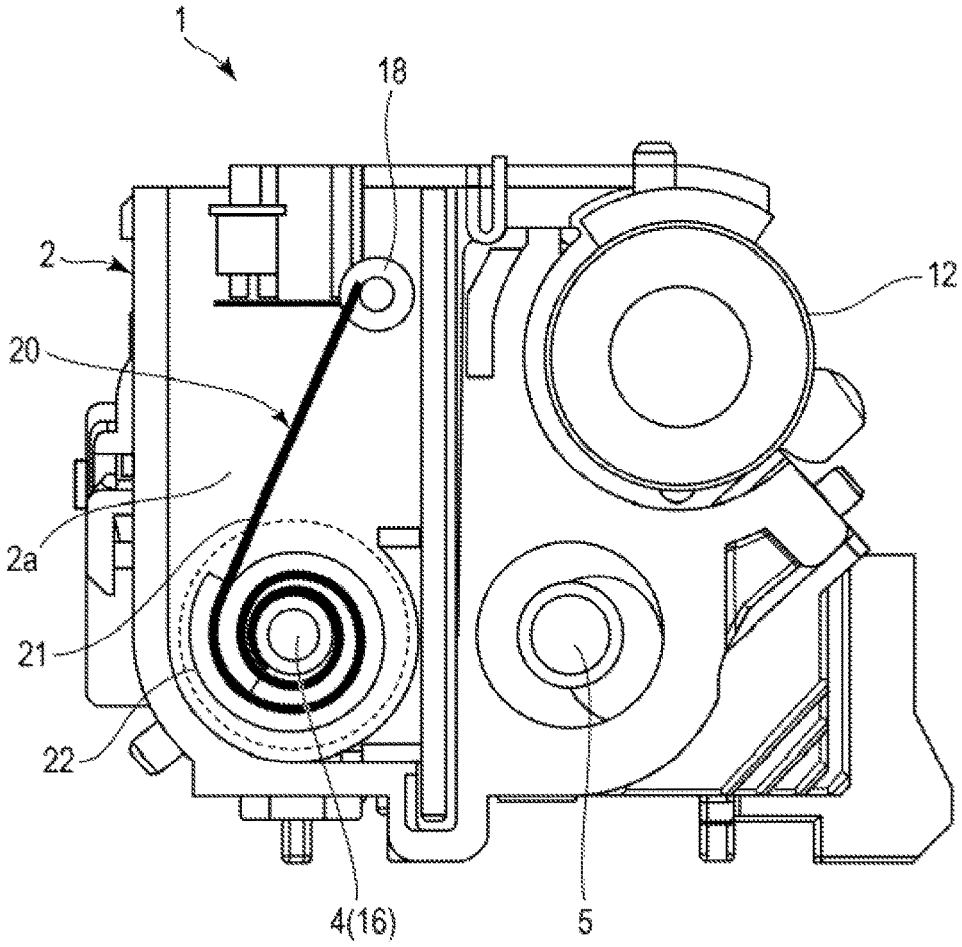
FIG. 12 is a front cross-sectional view of the developing apparatus in a state in which a sealing tape is attached.

FIG. 11A is a side cross-sectional view of the developing apparatus 1 taken along a plane that includes the rotation axis of the first screw 4 in a state in which the sealing tape 20 is attached, and illustrates the vicinity of the downstream side end in the first feeding direction A. FIG. 11B is an enlarged view of a part of FIG. 11A. FIG. 12 is a front cross-sectional view of the developing apparatus 1 in a state in which the sealing tape 20 is attached.

In the present embodiment, the sealing tape 20 that is a band-like member that is long in one direction is adopted as the sealing member that seals the inlet part 8. By winding the sealing tape 20 around the shaft part 16, a sealing layer 20*a* is formed as a blocking part that blocks passage of the developer D between the reverse feeding part 4*c* and the side wall 2*d*. In the present embodiment, the first rotary shaft 4*b* and the third rotary shaft 6*b* are integrally formed, and the shaft part 16 that connects the aforementioned first rotary shaft 4*b* and third rotary shaft 6*b* penetrates through the inlet part 8. In the present embodiment, the sealing tape 20 is wound around a portion of the shaft part 16 that is disposed in the agitating chamber 2*a*. When the sealing tape 20 is wound around the shaft part 16, the sealing tape 20 increases the thickness in the radial direction of the shaft part 16, and the size (external diameter) thereof in the same direction becomes larger than the size of the inlet part 8. Further, in a state in which the sealing tape 20 is wound around the shaft part 16, at least one portion of the sealing tape 20 contacts against both an end face 4*c*1 on the side wall 2*d* side of the reverse feeding part 4*c* and a wall face 2*d*1 on the reverse feeding part 4*c* side of the side wall 2*d*, and the sealing tape 20 can be compressed between the end face 4*c*1 and the wall face 2*d*1. By this means, the sealing layer 20*a* that prevents the developer D moving from the outer side of the sealing tape 20 to the shaft part 16 side is formed between the reverse feeding part 4*c* and the side wall 2*d*. In the present embodiment, the end face 4*c*1 of the reverse feeding part 4*c* and the wall face 2*d*1 of the side wall 2*d* are each substantially flat (approximately parallel with the vertical direction). Further, in the present embodiment, the inlet part 8 is approximately circular when viewed in the axial direction of the shaft part 16.

At the time of starting use of the developing apparatus 1 when the image forming apparatus 100 is initially installed or when the developing apparatus 1 is replaced, prior to starting of a driving input to the developing apparatus 1, the sealing tape 20 is in a state in which the sealing tape 20 is wound around the shaft part 16 as illustrated in FIGS. 11A and 11B, thereby sealing the inlet part 8.

Figure 13A:
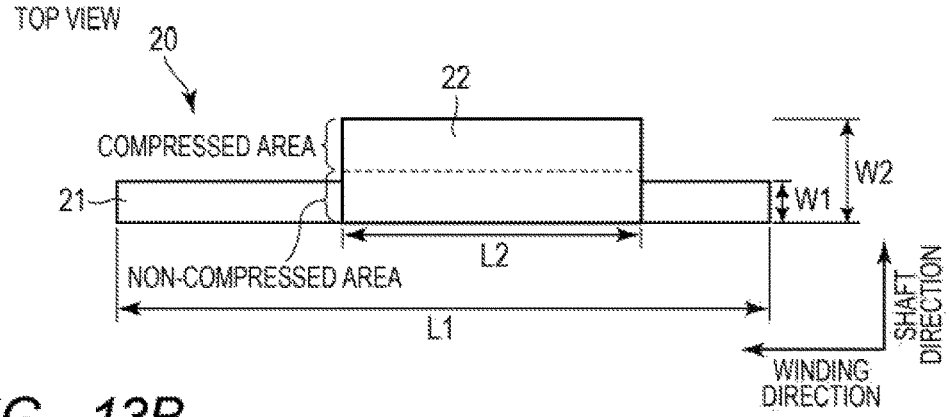
FIG. 13A is a top view of the sealing tape.
Figure 13B:
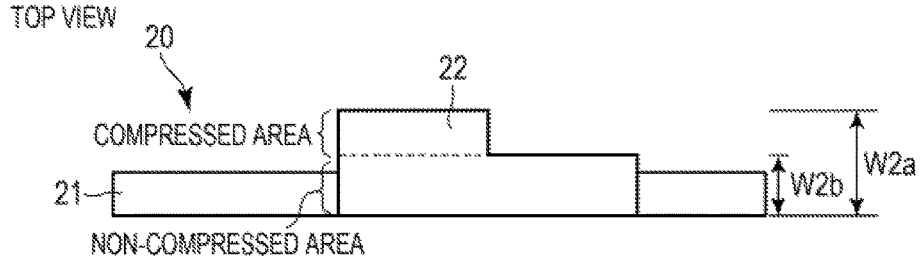
FIG. 13B is a top view of a sealing tape of a modification example.
Figure 13C:
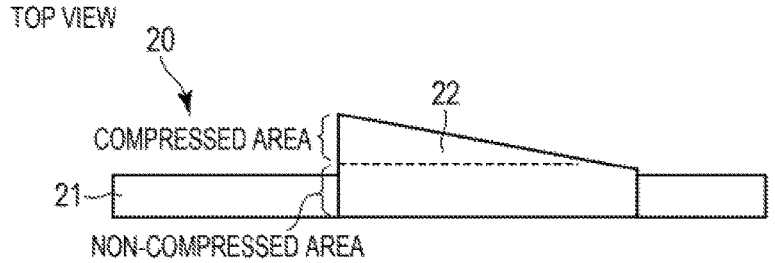
FIG. 13C is a top view of a sealing tape of a modification example.
Figure 13D:
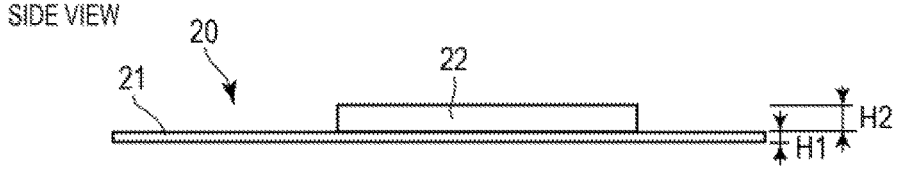
FIG. 13D is a side view of a sealing tape.

FIGS. 13A to 13D are top views and a side view of the sealing tape 20 in a component state. FIGS. 13A and 13D are a top view and a side view of the sealing tape 20 that is used in the present embodiment, respectively. FIGS. 13B and 13C are top views of the sealing tape 20 of modification examples. The right side in FIGS. 13A to 13D is the side on which winding of the sealing tape 20 onto the shaft part 16 in the longitudinal direction starts.

In the present embodiments as illustrated in FIGS. 13A and 13D, the sealing tape 20 has a two-layer structure in which an elastic member 22 is superposed and fixed on a sheet member 21. In the present embodiment, the elastic member 22 is attached by adhesive bonding to the sheet member 21. A member formed of plastic or fabric can be used as the sheet member 21, and in the present embodiment a film that is formed of plastic is used. A member formed of sponge or non-woven fabric can be used as the elastic member 22, and in the present embodiment a sheet formed of sponge (for example, urethane foam) is used. The elastic member 22 is compressed between the reverse feeding part 4*c* and the side wall 2*d*, and has sufficient elasticity (compressibility) to be able to prevent the developer D moving between the reverse feeding part 4*c* and the side wall 2*d*.

In the longitudinal direction of the sealing tape 20 (winding direction when wound around the shaft part 16), a length L1 of the sheet member 21 is longer than a length L2 of the elastic member 22. Further, the elastic member 22 is fixed to the sheet member 21 in a manner such that a portion with which the elastic member 22 does not overlap is left at both ends in the longitudinal direction of the sheet member 21. In the cross direction of the sealing tape 20 (axial direction of the shaft part 16 when the sealing tape 20 is wound around the shaft part 16), a width W2 of the elastic member 22 is wider than a width W1 of the sheet member 21. In the elastic member 22, a side part on the reverse feeding part 4*c* side in the axial direction of the shaft part 16 when the elastic member 22 is wound around the shaft part 16 is fixed to the sheet member 21 so as to match a side part of the sheet member 21. Although in the present embodiment the elastic member 22 projects only from one of the side part sides of the sheet member 21 in the cross direction of the sealing tape 20, a configuration may also be adopted in which the elastic member 22 projects from both side parts. In the present embodiment, the width W1 of the sheet member 21 is made approximately identical over the whole area in the longitudinal direction of the sheet member 21, and the width W1 is smaller than the distance between the reverse feeding part 4*c* and the side wall 2*d* in the axial direction of the shaft part 16. The width W2 of the elastic member 22 is made approximately identical over the whole area in the longitudinal direction of the elastic member 22, and the width W2 is greater than the distance between the reverse feeding part 4*c* and the side wall 2*d* in the axial direction of the shaft part 16. A thickness H2 of the elastic member 22 is thicker than a thickness H1 of the sheet member 21.

In the present embodiment, the elastic member 22 is pinched between the reverse feeding part 4*c* and the side wall 2*d* from both aides in the cross direction, and a portion that projects from the sheet member 21 in the cross direction is compressed, thereby forming the sealing layer 20*a*. On the other hand, in the present embodiment, the end of the sheet member 21 on the side wall 2*d* side in the cross direction does cot contact against the side wall 2*d*, and is not compressed between the reverse feeding part 4*c* and the side wall 2*d*. Thus, in the present embodiment, the sealing tape 20 is constructed so as to be wound multiple times around the shaft part 16. The sealing tape 20 has a first portion (non-compressed area) that is not compressed between the reverse feeding part 4*c* and the side wall 2*d*. Further, the sealing tape 20 has a second portion (compressed area) which is located on the outer side relative to the first portion in a state in which the sealing tape 20 is wound around the shaft part 16, and which is compressed between the reverse feeding part 4*c* and the side wall 2*d* to form the sealing layer 20*a*. In the present embodiment, the sealing tape 20 includes the sheet member 21 and the elastic member 22 that is superposed on the sheet member 21, and at least one portion (in the present embodiment, the entire region in the longitudinal direction) of the elastic member 22 constitutes the second portion.

The sealing tape 20 is wound around the shaft part 16 so that one of the ends (the right-side end in FIGS. 13A to 13D) in the longitudinal direction of the sheet member 21 is capable of relative movement (capable of idle rotation) with respect to the shaft part 16. Further, in the sealing tape 20, the other end of the sheet member 21 is fixed to the wind-up shaft 18 as a wind-up member. In the present embodiment, the wind-up shaft 18 is a common member with the member that winds the first sealing sheet 17*a* and the second sealing sheet 17*b*. By winding the sealing tape 20 around the shaft part 16 in an idly rotatable manner, when winding up the sealing tape 20 as described later, a restriction on the rotational speed of the wind-up shaft 18 and the shaft part 16 can be eliminated.

The sealing tape 20 can be constructed so that the sealing layer 20*a* can be formed by winding the sealing tape 20 fully around the shaft part 16 at least one time. More specifically, the sealing tape 20 can be constructed so that a portion forming the sealing layer 20*a* by contacting against both the reverse feeding part 4*c* and the side wall 2*d*, and preferably being compressed between the reverse feeding part 4*c* and the side wall 2*d*, is wound fully around the shaft part 16 at least one time. In the present embodiment, the whole area in the longitudinal direction of the elastic member 22 functions as the compressed area, and the elastic member 22 is wound, around the shaft part 16 a plurality of times.

Sealing tapes 20 having the shapes illustrated in FIGS. 13B and 13C can be mentioned as modification examples of the sealing tape 20. In the sealing tape 20 illustrated in FIG. 13B, the shape of the elastic member 22 includes a compressed area that forms the sealing layer 20*a*, and a non-compressed area that does not form the sealing layer 20*a*. A width W2*b* of the elastic member 22 of the non-compressed area is less than a width W2*a* of the elastic member 22 of the compressed area. Further, in the sealing tape 20 illustrated in FIG. 13C, the elastic member 22 has a shape in which the width continuously increases from a non-compressed area that does not form the sealing layer 20*a* to a compressed area that forms the sealing layer 20*a*. In each of the sealing tapes 20 in FIGS. 13B and 13C, the non-compressed area of the elastic member 22 is disposed on the side at which winding onto the shaft part 16 starts in the longitudinal direction of the sealing tape 20. That is, the elastic member 22 is formed so that, in a state in which the sealing tape 20 is wound around the shaft part 16, the compressed area is located on the outer side relative to the non-compressed area. By adopting this shape, the occurrence of a situation in which a portion of the sealing tape 20 that is close to the center of rotation of the shaft part 16 becomes caught in the inlet part 8 can be suppressed. Further, by as much as possible, making a portion forming the sealing layer 20*a* only a portion that forms an outer circumferential part when the sealing tape 20 is wound around the shaft part 16, it is possible to reduce the winding torque when winding the sealing tape 20.

8. Unsealing Operation

One end of each of the first sealing sheet 17*a*, the second sealing sheet 17*b* and the sealing tape 20 is fixed to the wind-up shaft 18 that is rotatably supported by the developing container 2. The wind-up shaft 18 is disposed outside a lid at the upper part of the developing container 2, and the first sealing sheet 17*a*, the second sealing sheet 17*b* and the sealing tape 20 may be fixed to the wind-up shaft 18 through a slit that is formed in the lid.

Figure 14:
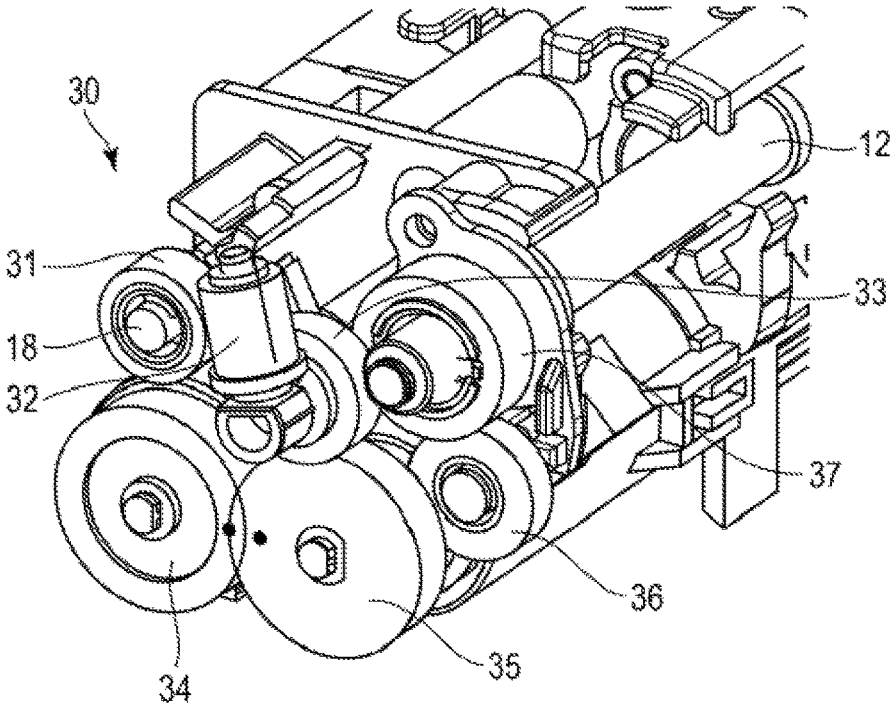
FIG. 14 is a perspective view illustrating a drive transmission part of the developing apparatus.

FIG. 14 is an external perspective view of one of the ends (right-side end in FIG. 2) of the developing apparatus 1, in which a drive transmission part 30 in the developing apparatus 1 is illustrated. In an unsealing mechanism, a wind-up drive gear 31 is provided at one end (right-side end in FIG. 2) of the wind-up shaft 18. The wind-up drive gear 31 is engaged with a worm gear 32, and the worm gear 32 is engaged with a distribution gear 33. The distribution gear 33 is engaged with a second feeding drive gear 35 that is provided at one end (right-side end in FIG. 2) of the second rotary shaft 5*b* of the second screw 5. A coupling (not illustrated) as a driving input part is provided at the other end (left-side end in FIG. 2) of the second rotary shaft 5*b* of the second screw 5. The coupling is drivingly coupled to a drive transmission member (not illustrated) that is provided in the main body of the image forming apparatus 100. When a rotational driving force is input to the second screw 5 through the aforementioned coupling from the driving motor 112 (FIG. 4) that is provided in the main body of the image forming apparatus 100, the second feeding drive gear 35 rotates. This rotational driving force is transmitted to the wind-up drive gear 31 via the distribution gear 33 and the worm gear 32, and thus the wind-up shaft 18 rotates.

The second feeding drive gear 35 is engaged with a first feeding drive gear 34 that is provided at one end (right-side end in FIG. 2) of the third rotary shaft 6*b* of the third screw 6. The third rotary shaft 6*b* of the third screw 6 and the first rotary shaft 4*b* of the first screw 4 are integrally formed. Accordingly, when the second feeding drive gear 35 rotates, the rotational driving force is transmitted to the first feeding drive gear 34, and the third screw 6 and the first screw 4 rotates. Further, the second feeding drive gear 35 is also connected through the transmission gear 36 to a development drive gear 37 that is provided at one end (right-side end in FIG. 2) of the rotary shaft of the developing sleeve 12. Accordingly, when the second feeding drive gear 35 rotates, the rotational driving force is transmitted to the development drive gear 37 through the transmission gear 36, and thus the developing sleeve 12 rotates.

When the wind-up shaft 18 rotates, the sealing tape 20 is wound up and unsealed, and the agitating chamber 2*a* and the discharge passage 2*c* communicate through the inlet part 8. Further, when the wind-up shaft 18 rotates, the first sealing sheet 17*a* and the second sealing sheet 17*b* are wound up and released, and the agitating chamber 2*a* and the developing chamber 2*b* communicate through the first communication part 7*a* and the second communication part 7*b*.

In the present embodiment, the developing apparatus 1 has the drive transmission part 30 as a driving unit that causes unsealing of the sealing tape 20, the first sealing sheet 17*a* and the second sealing sheet 17*b* and rotation of the first screw 4 and the third screw 6 to be performed in conjunction with each other.

Figure 15:
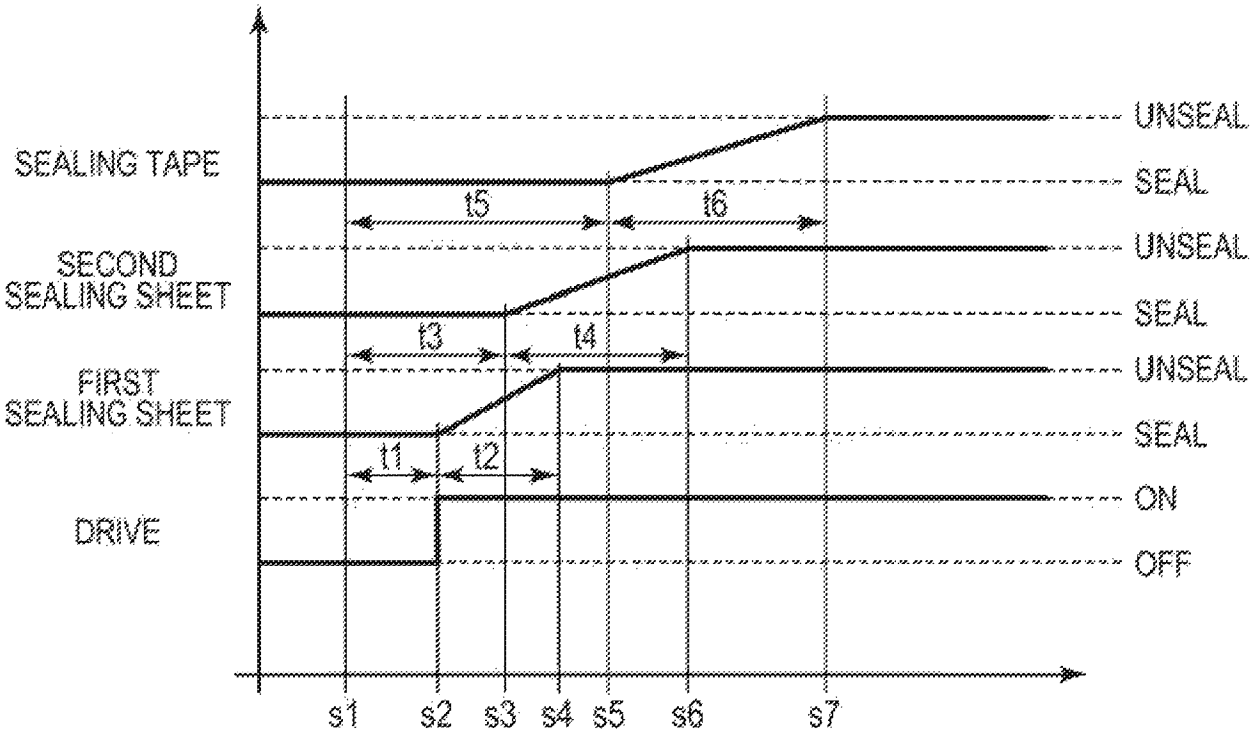
FIG. 15 is a timing chart that illustrates timings for unsealing a sealing tape.

The procedures for unsealing the first sealing sheet 17*a*, the second sealing sheet 17*b* and the sealing tape 20 in the present embodiment will now be described referring to FIG. 15. FIG. 15 is a timing chart of the aforementioned unsealing procedures.

At a timing s1, upon the start of a driving input to the second screw 5, feeding of the developer D inside the agitating chamber 2*a* in the first feeding direction A is started. Further, by rotation of the wind-up shaft 18, winding up of the excess length of the first sealing sheet 17*a* is performed during a period until a time t1 passes from the timing s1. Thereafter, at a timing s1, unsealing of the first sealing sheet 17*a* is started, and opening of the first communication part 7*a* is started. When the first communication part 7*a* starts to be opened at the timing s2, the developer D that has been fed to the downstream side end in the first feeding direction A of the agitating chamber 2*a* passes through the first communication part 7*a* and is fed to the developing chamber 2*b*. At the timing s2, because the inlet part 8 is being blocked by the sealing tape 20, the developer D that passed over the reverse feeding part 4*c* is also returned by the reverse feeding part 4*c* to the circulation path of the developer D that is formed by the agitating chamber 2*a* and the developing chamber 2*b*, without entering the discharge passage 2*c*. Subsequently, at a timing s4 that is a time t2 after the timing s2, unsealing of the first sealing sheet 17*a* ends and the first communication part 7*a* is completely opened.

Further, winding op of the excess length of the second sealing sheet 17*b* is performed during a period until a time t3 ($t1<t3<(t1+t2)$) passes from the timing s1. Thereafter, at a timing s3, unsealing of the second sealing sheet 17*b* is started. When the second communication part 7*b* starts to be opened at the timing s3, circulation of the developer D between the agitating chamber 2*a* and the developing chamber 2*b* is started. Subsequently, at a timing s6 that is a time t4 after the timing s3, unsealing of the second sealing sheet 17*b* ends, and the second communication part 7*b* is completely opened.

Furthermore, winding up of the excess length of the sealing tape 20 is performed during a period until a time t5 (t3<t5<(t3+t4)) passes from the timing s1. Thereafter, at a timing s5, unsealing of the sealing tape 20 is started. Subsequently, at a timing s7 that is a time t6 after the timing s5, unsealing of the sealing tape 20 ends and the inlet part 8 is completely opened, and the agitating chamber 2*a* and the discharge passage 2*c* communicate.

According to the unsealing procedures described above, at least one portion of the initial developer D that was filled in advance into the agitating chamber 2*a* is fed to the developing chamber 2*b*, and after the height of the surface level of the initial developer D inside the agitating chamber 2*a* decreases sufficiently, unsealing of the sealing tape 20 is started. Therefore, when starting usage of the developing apparatus 1 at a time of initial installation of the image forming apparatus 100 or at a time of replacing the developing apparatus 1, it is possible to suppress the occurrence of a situation in which the initial developer D is discharged from the discharging port 10.

In the present embodiment, the timing for starting unsealing of the first sealing sheet 17*a* is made earlier than the timing for starting unsealing of the second sealing sheet 17*b*. This is done to suppress the occurrence of a situation in which the developer D concentrates on the downstream side in the first feeding direction A. and the height of the surface level of the developer D rises. In addition, this is done to suppress the occurrence or damage to the drive system due to an increase in the drive torque as well as locking of the first screw 4 as a result of an increase in pressure that is caused by the developer D on the downstream side. However, the unsealing procedures are not limited to the procedures described above. The timing at which to start unsealing of the sealing tape 20 can be set to after the timing at which unsealing of the first sealing sheet 17*a* is started. At the timing at which unsealing of the first sealing sheet 17*a* ends, the surface level of the developer D inside the developing container 2, particularly on the downstream side end in the first feeding direction A of the agitating chamber 2*a*, has been evened out to an equivalent degree as when operating in a steady state after usage of the developing apparatus 1 is started. Therefore, the timing at which to start unsealing of the sealing tape 20 may be set to a timing that is after the first sealing sheet 17*a* is unsealed (after unsealing has ended).

In a case where the timing at which to start unsealing of the sealing tape 20 is earlier than the timing at which to start unsealing of the first sealing sheet 17*a*, the operations will be as follows. That is, the initial developer D that has been fed to the downstream side end in the first feeding direction A of the agitating chamber 2*a* will pass through the inlet part B simultaneously with the start of unsealing of the sealing tape 20 and will flow into the discharge passage 2*c*. Further, upon the first sealing sheet 17*a* being unsealed and the initial developer D being fed into the developing chamber 2*b* or the initial developer D flowing into the discharge passage 2*c*, the initial developer D will be discharged until the height of the surface level of the developer D inside the agitating chamber 2*a* falls to a predetermined height. In a case where, due to transportation conditions or the like, the initial developer D that is inside the developing apparatus 1 is unevenly distributed on the downstream side in the first feeding direction A before driving input starts, there is a possibility that the discharged amount of the initial developer D will be large. Accordingly, it is important to set the timing for starting unsealing of the sealing tape 20 to a timing that is later than the timing for starting unsealing of the first sealing sheet 17*a* and that is at or after a time at which the height of the surface level of the initial developer D inside the agitating chamber 2*a* has decreased to a predetermined height.

The timings at which to start unsealing of the sealing tape 20, the first sealing sheet 17*a* and the second sealing sheet 17*b* as well as the unsealing speed can be adjusted in accordance with the excess length of each sealing member and the external diameter of a portion of each sealing member that is wound up at the wind-up shaft 18. The excess length of the sealing tape 20 is the length, of a portion to be wound up by the wind-up shaft 18 by a time (unsealing start timing) at which movement (winding up) of a portion that is wound around the shaft part 16 and that forms the sealing layer 20*a* starts. Further, the excess length of each of the first sealing sheet 17*a* and the second sealing sheet 17*b* is the length of a portion to be wound up by the wind-up shaft 18 by a time (unsealing start timing) at which stripping off of a portion that is affixed to the circumference of the first communication part 7*a* and the second communication part 7*b*, respectively, starts. For example, with regard to the first sealing sheet 17*a* in a case where it is desired to make the unsealing start timing an early timing and to make the unsealing speed fast, the excess length can be set to a short length to shorten the time t1, and the external diameter of a wind-up portion of the wind-up shaft 18 can be made a large diameter to shorten the time t2. With regard to the sealing tape 20 in a case where it is desired to make the unsealing start timing a late timing and to make the unsealing speed slow, the excess length can be set to a long length to lengthen the time t5, and the external diameter of the wind-up portion of the wind-up shaft 18 can be made a small diameter to lengthen the time t6. With, regard to the second sealing sheet 17*b*, for example, the times t3 and t4 can be adjusted and set so as not to overlap with an interval during which torque increases when winding up the second sealing sheet 17*b*.

As described above, according to the present embodiment, by providing the sealing tape 20 between the reverse feeding part 4*c* and the side wall 2*d*, entry of the initial developer D into the discharge passage 2*c* during transportation of the image forming apparatus 100 or the developing apparatus 1 can be suppressed. Further, by starting unsealing of the sealing tape 20 after circulation of the developer D has started, even in a case where feeding of the developer D is performed in conjunction with automatic unsealing of a sealing member, entry of the initial developer D into the discharge passage 2*c* at the time of starting usage of the developing apparatus 1 can be suppressed. According to the present embodiment, even in a case where uneven distribution of the initial developer D inside the developing apparatus 1 is liable to occur prior to the start of driving input due to transportation conditions or the like, entry of the initial developer D into the discharge passage 2*c* during transportation or when starting to use the developing apparatus 1 can be suppressed. Therefore, the occurrence of image defects due to insufficient volume of the initial developer D can be suppressed. Furthermore, as it is unnecessary to perform work to solve a problem of an insufficient volume of the initial developer D, it is possible to shorten the work time and simplify the work procedures with respect to work to be performed when initially installing the image forming apparatus 100 and when replacing the developing apparatus 1.

Embodiment 2

Next, Embodiment 2 of the present invention will be described. The fundamental configuration and operations of an image forming apparatus of the present embodiment are the same as the image forming apparatus of Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

1. Initial Developer Encapsulation. Configuration

Figure 16:
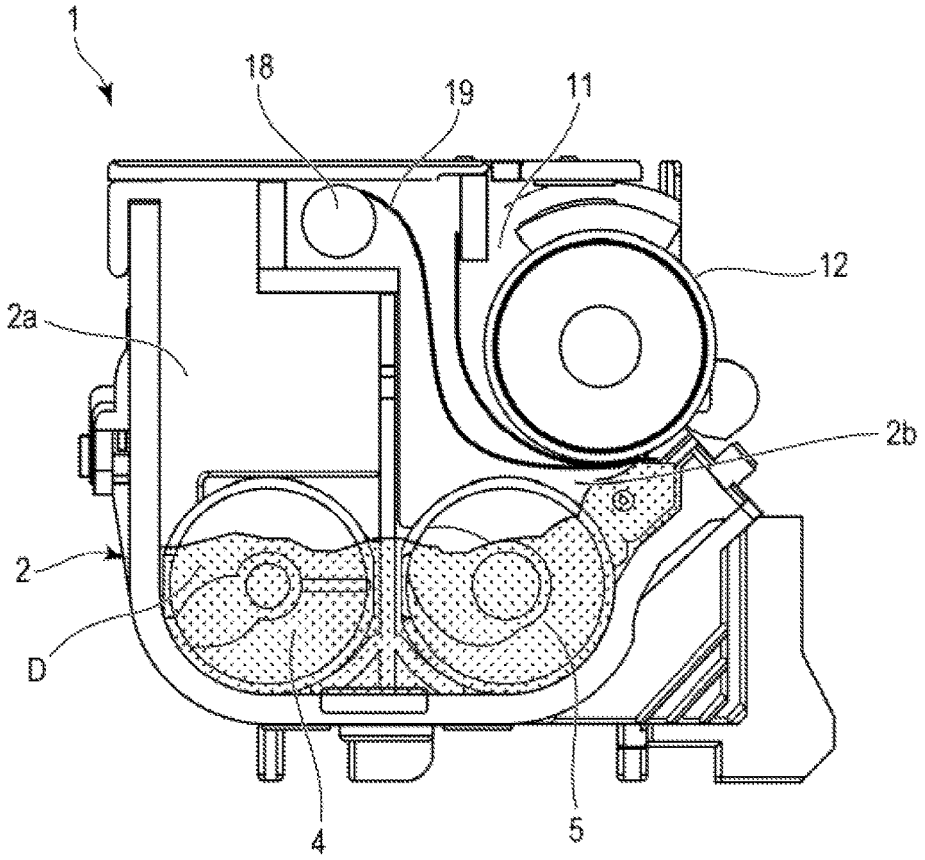
FIG. 16 is a front cross-sectional view of another example of the developing apparatus.

FIG. 16 is a front cross-sectional view of the developing apparatus 1 of the present embodiment. In the present embodiment, a sealing sheet 19 as a developer sealing member is disposed between the developer opening part 11 and the developing sleeve 12, to thereby make the inside of the developing container 2 a sealed space. The initial developer D is filled into the agitating chamber 2*a* and the developing chamber 2*b*. The sealing sheet 19 is constituted by a band-like sheet, member having a width in the rotation axis direction of the photosensitive drum 101 that is equal to the width of the developer opening part 11. One end in the longitudinal direction (winding up direction) of the sealing sheet 19 is affixed in an unseal able manner (a strippable manner) from the interior side of the developing chamber 2*b* to a wall surface of the developing container 2 around the developer opening part 11 in a manner so that the inside of the developing container 2 becomes a sealed space. The one end in the longitudinal direction of the sealing sheet 19 is affixed from the upper side toward the lower side of the developer opening part 11, and is folded back at the lower end side of the developer opening part 11. The other end in the longitudinal direction of the sealing sheet 19 is fixed to the wind-up shaft 18. The sealing sheet 19 is unsealed by being wound up by the wind-up shaft 18.

In the present embodiments similarly to Embodiment 1, the discharge passage 2*c* is provided in a continuous manner on the downstream side of the agitating chamber 2*a* in the first feeding direction A. The discharge passage 2*c* is not limited to being provided in a continuous manner on the downstream side of the agitating chamber 2*a* in the first feeding direction A. However, according to this arrangement, prior to the developer D being fed to the developing chamber 2*b* in which the developing sleeve 12 is disposed, at the downstream side end of the agitating chamber 2*a* the surface level height of the developer D can be adjusted by means of the structure of the discharge passage 2*c*. By this means, it is possible to stably control the volume of the developer D inside the developing apparatus 1. However, the discharge passage 2*c* may be provided in a continuous manner on the downstream side of the developing chamber 2*b* in the second, feeding direction B. In that case, the developing chamber 2*b* is the first chamber in which the discharge passage 2*c* is disposed in a continuous manners, and the agitating chamber 2*a* is the second chamber that forms the circulation path of the developer D together with the developing chamber 2*b*. In such a case also, the same arrangements and configurations as in the present embodiment can be adopted with respect to the forward feeding part, the reverse feeding part, the inlet part, the discharge passage (third chamber) and the sealing tape in the developing chamber 2*b*.

In the present embodiment, the initial developer D is dispersed between the agitating chamber 2*a* and the developing chamber 2*b*. Consequently, the height of the surface level of the initial developer D becomes lower than in the configuration of Embodiment 1. However, there is a possibility that the initial developer D will be unevenly distributed at the vicinity of the inlet part 8 during transportation of the image forming apparatus 100 or the developing apparatus 1. In such a case, there is a possibility that the initial developer D will enter the discharge passage when starting to use the developing apparatus 1 and will be discharged from the discharging port 10.

Therefore, in the present embodiment, similarly to Embodiment 1, the sealing tape 20 as a sealing member that seals the inlet part 8 is provided between the reverse feeding part 4*c* and the side wall 2*d*. By blocking the inlet part 8 with the sealing tape 20, entry of the initial developer D into the discharge passage 2*c* is suppressed until the sealing tape 20 is unsealed.

2. Unsealing Operation

The configuration of the drive transmission part 30 in the developing apparatus 1 of the present embodiment is the same as in the developing apparatus 1 of Embodiment 1. When a driving input to the developing apparatus 1 is started, the first screw 4 and the second screw 5 rotate and circulation of the developer D starts. In addition, the wind-up shaft 18 rotates and winding up of the sealing sheet 19 that is blocking supply of the developer D to the developing sleeve 12 starts. As a result of the sealing sheet 19 being unsealed, coating of the developer D onto the developing sleeve 12 is enabled. After the uneven distribution of the Initial developer D is evened out by the initial developer D being caused to circulate by the first screw 4 and the second screw 5, unsealing of the sealing tape 20 is started and the inlet part 8 is opened.

In the present embodiment, the developing apparatus 1 has the drive transmission part 30 as a driving unit that causes unsealing of the sealing tape 20 and the sealing sheet 19 and rotation of the shaft part 16 (first screw 4 and third screw 6) to be performed in conjunction with each other.

In the present embodiment, the initial developer D is dispersed between the agitating chamber 2*a* and the developing chamber 2*b*. However, there is a possibility that the initial developer D will become unevenly distributed at the vicinity of the inlet part 8 during transportation of the image forming apparatus 100 or the developing apparatus 1. Consequently, if unsealing of the sealing tape 20 it is started before the uneven distribution of the initial developer D is evened out by the initial developer D being caused to circulate by the first screw 4 and the second screw 5, there is a possibility that the developer D will enter the discharge passage 2*c*. Accordingly, it is important that unsealing of the sealing tape 20 is started after uneven distribution of the height of the surface level of the initial developer D inside the developing container 2 is evened out sufficiently. That is, the timing at which to start unsealing the sealing tape 20 can be set to after a timing at which feeding of the developer D by the first screw 4 is started and transfer of the developer D to the developing chamber 2*b* from the agitating chamber 2*a* through the first communication part 7*a* is started. At the timing at which unsealing of the sealing sheet 19 ends and coating of the developer D onto the developing sleeve 12 is enabled, the surface level of the developer D inside the developing container 2 has been evened out to an equivalent degree as when operating in a steady state after usage of the developing apparatus 1 is started. Therefore, the timing at which to start unsealing of the sealing tape 20 can be set to a timing that is after the sealing sheet 19 is unsealed (after unsealing has ended).

As described above, according to the present embodiment, the sealing tape 20 is provided between the reverse feeding part 4*c* and the side wall 2*d*. By this means, entry of the initial developer D into the discharge passage 2*c* during transportation of the image forming apparatus 100 or the developing apparatus 1 can be suppressed. Further, unsealing of the sealing tape 20 is started after circulation of the developer D is started. By this means, even in a case where uneven distribution of the initial developer D inside the developing apparatus 1 has occurred during transportation, entry of the initial developer D into the discharge passage 2*c* when starting use of the developing apparatus 1 can be suppressed.

Embodiment 3

Next, Embodiment 3 of the present invention will be described. The fundamental configuration and operations of an image forming apparatus of the present embodiment are the same as the image forming apparatus of Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

1. Discharge Passage Sealing Configuration

In the present embodiment, as a sealing member that is provided between the reverse feeding part 4*c* of the first screw 4 and the side wall 2*d* that partitions the agitating chamber 2*a* and the discharge passage 2*c*, the developing apparatus 1 is provided with a sealing tube 40, described hereunder, in place of the sealing tape 20 of Embodiments 1 and 2.

Figure 17B:
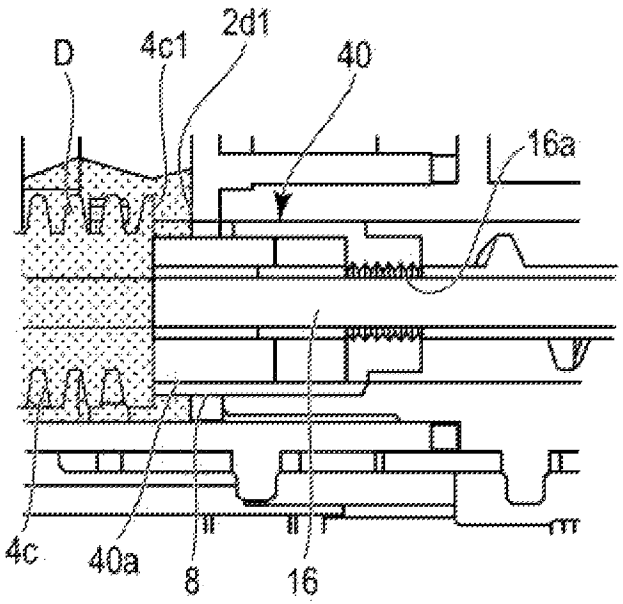
FIG. 17B is a partially enlarged view of FIG. 17A.
Figure 17A:
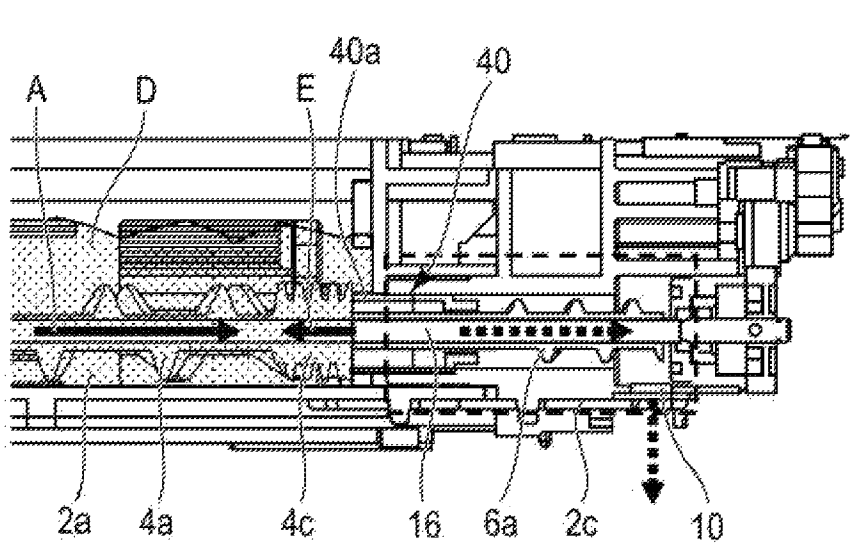
FIG. 17A is a side cross-sectional view of the developing apparatus in a state in which a sealing tube is attached.
Figure 18A:
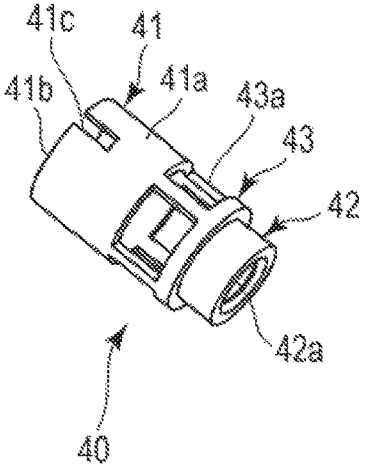
FIG. 18A is a perspective view illustrating a component state of the sealing tube.
Figure 18B:
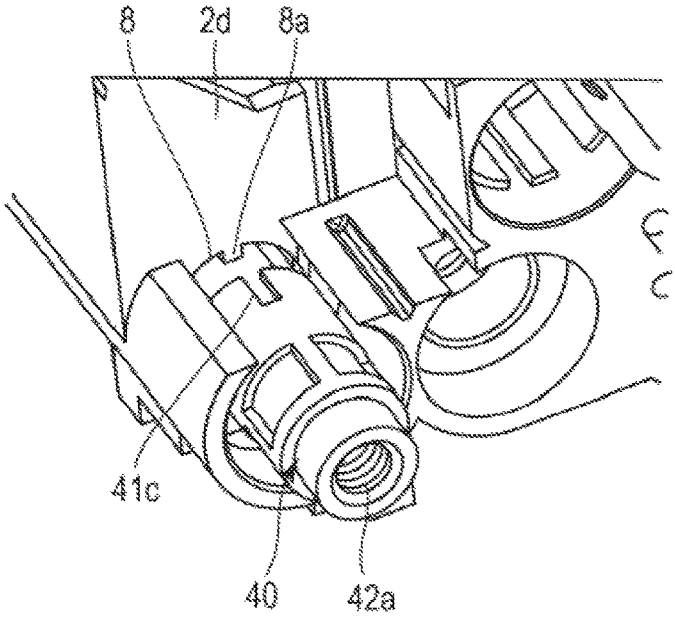
FIG. 18B is a perspective view illustrating an assembled state of the sealing tube.

FIG. 17A is a side cross-sectional view of the developing apparatus 1 taken along a plane that includes the rotation axis of the first screw 4 in a state in which the sealing tube 40 is attached, and illustrates the vicinity of the downstream side end in the first feeding direction A. FIG. 17B is an enlarged view of a part of FIG. 17A. FIG. 18A is a perspective view of the sealing tube 40 in a component state. FIG. 18B is a perspective view illustrating a state in which the sealing tube 40 is assembled in the developing apparatus 1.

In the present embodiment, the sealing member that seals the inlet part 8 is the sealing tube 40 that is a tubular member. The sealing tube 40 is inserted into the inlet part 8, and together therewith one end of the sealing tube 40 abuts against the reverse feeding part 4*c*. By this means, a blocking wall 40*a* is formed as a blocking part, that prevents passage of the developer D, between the reverse feeding part 4*c* and the side wall 2*d*. In the present embodiment, the first rotary shaft 4*b* and the third rotary shaft 6*b* are integrally formed, and the shaft part 16 that connects the first rotary shaft 4*b* and the third rotary shaft 6*b* passes through the inlet part 8. In the present embodiment, the sealing tube 40 is attached to the shaft part 16 in a manner such that the shaft part 16 is passed through a hollow part of the sealing tube 40. In the sealing tube 40, an external surface 41*a* interfits into with the inlet part 8, and an end face 11*b* abuts against the end face 4*c*1 on the side wall 2*d* side of the reverse feeding part 4*c*. By this means, the blocking wall 40*a* is formed so as to surround the circumference of the shaft part 16 between the end face 4*c*1 on the side wall 2*d* side of the reverse feeding part 4*c* and the wall face 2*d*1 on the reverse feeding part 4*c* side of the side wall 2*d*. The blocking wall 40*a* prevents the developer D from moving from the outer side of the sealing tube 40 to the shaft part 16 side. In the present embodiment, the end face 4*c*1 of the reverse feeding part 4*c* and the end face 41*b* of the sealing tube 40 are each substantially flat (approximately parallel with the vertical direction). Further, in the present embodiment, the inlet part 8 is approximately circular when viewed in the axial direction of the shaft part 16.

As illustrated in FIGS. 18A and 18B, the sealing tube 40 has a tubular (in the present embodiment, an approximately cylindrical) sealing part 41 on the upstream side in the first feeding direction A. In the sealing part 41, the external surface 41*a* along (In the present embodiment, approximately parallel to) the axial direction of the shaft part 16 is formed so as to interfit with the inlet part 8. In addition, in the sealing part 41, the end face 41*b* along a direction intersecting with (in the present embodiment, approximately orthogonal to) the axial direction of the shaft part 16 is formed so as to abut with the end face 4*c*1 of the reverse feeding part 4*c*. In the sealing part 41, a groove (concave portion) 41*c* is formed so as to engage with a convex portion 8*a* provided in the inlet part 8. The groove 41*c* and the convex portion 8*a* engage with each other to function as a rotation preventing part that prevents rotation of the sealing tube 40. The convex portion may be provided on the sealing tube 40 side, and the groove (concave portion) may be provided on the inlet part 8 side. The sealing tube 40 has a tubular (in the present embodiment, an approximately cylindrical) engagement part 42 on the downstream side in the first feeding direction A. An inner face of the engagement part 42 along (in the present embodiment, approximately parallel to) the axial direction of the shaft part 16 engages with the shaft part 16. In the inner circumferential face of the engagement part 42, an internal thread portion 42*a* is provided so as to screw together with an external thread portion 16*a* that is provided at one part of a portion of the shaft part 16 that is disposed in the discharge passage 2*c*. The sealing tube 40 includes, between the sealing part 41 and the engagement part 42, a pass-through part 43 in which an opening part 43*a* that allows the developer D that entered a hollow pert of the sealing part 41 to exit into the discharge passage 2*c* is formed.

At the time of starting use of the developing apparatus 1 when the image forming apparatus 100 is initially installed or when the developing apparatus 1 is replaced, prior to the start of a driving input to the developing apparatus 1, the sealing tube 40 is at the position illustrated in FIGS. 17A and 17B. That is, the end face 41*b* of the sealing part 41 abuts against the end face 4*c*1 of the reverse feeding part 4*c* so that the inlet part B is sealed, and the internal thread portion 42*a* of the engagement part 42 is engaged with the external thread portion 16*a* of the shaft part 16.

2. Unsealing Operation

The configuration of the drive transmission part 30 in the developing apparatus 1 of the present embodiment is the same as in the developing apparatus 1 of Embodiment 1. When a driving input is started to the developing apparatus 1, the first screw 4, the second screw 5 and the third screw 6 rotate, and the wind-up shaft 18 rotates together therewith. When the wind-up shaft 18 rotates, the first sealing sheet 17*a* and the second sealing sheet 17*b* are wound up and unsealed, and the agitating chamber 2*a* and the developing chamber 2*b* communicate through the first communication part 7*a* and the second communication part 7*b*. When the driving input is started to the developing apparatus 1, the shaft part 10 rotates integrally with the first screw 4 and the third screw 6. At this time, because the internal thread portion 42*a* of the sealing tube 40 and the external thread portion 16*a* of the shaft part 16 are engaged with each other, when the shaft part 16 rotates, the sealing tube 40 also attempts to start to rotate. However, the groove 41*c* of the sealing tube 40 and the convex portion 8*a* of the inlet part 8 engage with each other and function as a rotation preventing part. Therefore, accompanying the rotation of the shaft part 16, the sealing tube 40 moves in the axial direction of the shaft part 16 so as to move away from the inlet part 8 and toward the discharging port 10.

Figure 19:
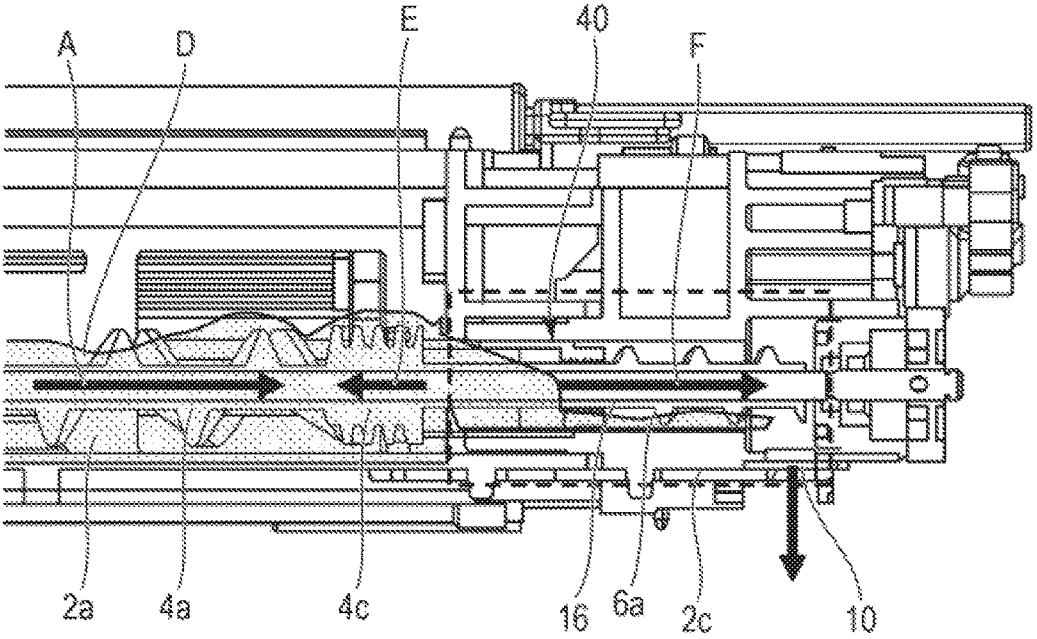
FIG. 19 is a side cross-sectional view of the developing apparatus for describing an operation that unseals the sealing tube.

FIG. 19 is a side cross-sectional view of the developing apparatus 1 taken along a plane that includes the rotation axis of the first screw 4 when the sealing tube 40 is in an unsealed state, and illustrates the state of the developer D in the vicinity of the downstream side end in the first feeding direction A. As a result of the sealing tube 40 moving, the end face 41*b* of the sealing tube 40 separates from the end face 4*c*1 of the reverse feeding part 4*c*, and the developer D starts to flow into the hollow part of the sealing part 41. The sealing tube 40 moves until the engagement part 42 finishes passing through the portion at which the external thread portion 16*a* of the shaft part 10 is formed. In this state, the agitating chamber 2*a* and the discharge passage 2*c* communicate through the hollow part of the sealing part 41 and the opening part 43*a* of the pass-through part 43.

The developer D that has flowed into the hollow part of the sealing part 41 is pushed in by more of the developer D that flows into the hollow part thereafter, and thus passes through the hollow part and reaches the inside of the discharge passage 2*c* through the opening part 43*a*. The developer D that has reached the inside of the discharge passage 2*c* is fed to the discharging port 10 by the third screw 6 and is discharged to outside of the developing apparatus 1 from the discharging port 10.

As described above, according to the present embodiment, the sealing tube 40 is provided between the reverse feeding part 4*c* and the side wall 2*d*. By this means, entry of the initial developer D into the discharge passage 2*c* during transportation of the image forming apparatus 100 or the developing apparatus 1 can be suppressed. Since the sealing tube 40 moves over the shaft part 16, the influence imparted to the driving load (rotation load) of the developing apparatus 1 by providing a sealing member of the inlet part 8 of the discharge passage 2*c* can be reduced.

Although in the present embodiment the discharge feeding part 6*a* is provided as a third feeding part on the shaft member disposed in the discharge passage 2*c*, the present invention is not limited to this configuration. For example, in a case where the discharging port 10 is adjacent to the inlet part 8 or in a case where the fluidity of the developer D is high, a feeding part such as a screw blade need not be provided on the shaft member disposed in the discharge passage 2*c*. In such a case, by adopting a configuration so that the sealing tube 40 moves from the inlet part 8 to a position that is beyond the discharging port 10 (for example, the end on the opposite side to the inlet part 8 of the discharge passage 2*c*), there is not necessity to provide an opening part in the sealing tube 40. In the present embodiment, the outer circumferential surface of the sealing tube 40 is a substantially cylindrical surface. However, for example, in a case where the fluidity of the developer D is low, a screw shape can foe provided in the outer circumferential surface of the sealing tube 40 to thereby increase a force that feeds the developer D from the inlet part 8 side toward the discharging port 10. Likewise, the inner circumferential face of the sealing tube 40 is also not limited to a cylindrical surface, and for example a screw shape may be provided to increase the force that feeds the developer D.

In the present embodiment an example has been described in which the sealing tube 40 is provided in the developing apparatus 1 that is equipped with a configuration for encapsulating the initial developer D that is the same as in Embodiment 1. However, the sealing tube 40 may also be provided in the developing apparatus 1 that is equipped with a configuration for encapsulating the initial developer D that is the same as in Embodiment 2.

Other

Although the present invention has been described in accordance with specific embodiments, the present invention is not limited to the above described embodiments.

For example, in Embodiments 1 and 2, the sealing tape 20 is taken as being a two-layer structure in which the elastic member 22 is affixed to the sheet member 21. This sheet member 21 can facilitate winding and winding up of the sealing tape 20. Further, formation of the sealing layer 20*a* is facilitated by the elastic member 22 changing shape in accordance with the shape of the end face 4*c*1 of the reverse feeding part 4*c* and the wall face 2*d*1 of the side wall 2*d*. However, the sealing tape 20 may be, for example, a monolayer structure homed by a similar member to that of the sheet member 21 or the elastic member 22 in Embodiments 1 and 2. Further, the sealing tape 20 may be a multi-layer structure having three layers or more. The material and driving configuration of the sealing tape 20 is not limited as long as the sealing tape 20 can block the inlet part 8 of the discharge passage 2*c*.

In Embodiment 3, the sealing tube 40 is taken as having an approximately cylindrical shape overall. However, the shape of the sealing tube 40 is not limited to a cylindrical shape. For example, the shape of the sealing part 41 at a cross section that is approximately orthogonal to the axial direction of the shaft member 16 may be, in conformity with the shape of the inlet part 8, an arbitrary shape such as a circular shape, an elliptical shape or a polygonal shape (such as a triangular shape, a quadrangular shape or a hexagonal shape). In a case where the shape of the cross section of the sealing part 41 is elliptical or polygonal, the groove (concave portion) and convex portion that function as the rotation preventing part in Embodiment 3 need not be provided.

In the foregoing embodiments, a configuration is described in which the first sealing sheet 17*a* and the second sealing sheet 17*b* that seal the first communication part 7*a* and the second communication part 7*b*, or the sealing sheet 19 that seals the developer opening part 11 are automatically unsealed. In this regard, the first sealing sheet 17*a* and the second sealing sheet 17*b* or the sealing sheet 19 may be manually unsealed. In such case, the first sealing sheet 17*a* and the second sealing sheet 17*b* or the sealing sheet 19, for example, are unsealed by the relevant end that is fixed to the wind-up shaft 18 in the above-described embodiments being pulled off by an operator. The sealing tape 20 or the sealing tube 40 that seals the inlet part 8 of the discharge passage 2*c* may also be unsealed manually. In such case, the sealing tape 20, for example, is unsealed by the relevant end that is fixed to the wind-up shaft 18 in the above-described embodiments being pulled off by an operator. The sealing tube 40, for example, can be configured so that the sealing tube 40 is unsealed when an operator rotates a knob connected to the shaft part 16. In a case where the first sealing sheet 17*a* and the second sealing sheet 17*b* or the sealing sheet 19 are manually unsealed also, a configuration can be adopted so that the sealing tape 20 or the sealing tube 40 is unsealed automatically or manually after the surface level of the initial developer D inside the developing container 2 has been evened out after the unsealing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-242444, filed Dec. 14, 2016, which is hereby incorporated by reference herein in its entirety.

What is claimed is:

1. A developing apparatus, comprising:

a developer bearing member bearing and feeding developer including toner and carrier in order to develop an electrostatic image formed on an image bearing member;

a developing container including a first chamber and a second chamber partitioned by a partition wall from the first chamber, and configured to contain the developer to be supplied to the developer bearing member;

a first communication portion configured to permit movement of the developer from the first chamber to the second chamber;

a second communication portion configured to permit movement of the developer from the second chamber to the first chamber;

a first feeding screw arranged in the first chamber and feeding the developer in a first direction from the second communication portion toward the first communication portion;

a second feeding screw arranged in the second chamber and including a first blade portion feeding the developer in a second direction from the first communication portion to the second communication portion, a second blade portion arranged downstream of the first blade portion in the second direction and feeding the developer in the first direction to deliver the developer through the second communication portion to the first chamber, and a third blade portion arranged downstream of the second blade portion in the second direction feeding the developer in the second direction;

a developer replenishing portion configured to replenish replenishment developer to the developing container;

a developer discharging portion configured to discharge a part of the developer contained in the developing container as the replenishment developer is replenished to the developing container by the developer replenishing portion;

a sealing sheet arranged upstream of the developer discharging portion in the second direction and sealing initial developer contained in the developing container; and an unsealing mechanism unsealing the sealing sheet sealing the initial developer, wherein the sealing sheet is arranged downstream of the second blade portion and upstream of the third blade portion in the second direction.

2. The developing apparatus according to claim 1, wherein the sealing sheet is attached to a most downstream end of the second blade portion in the second direction.

3. The developing apparatus according to claim 1, further comprising a driving force receiving portion configured to receive a driving force, supplied from a driving source, for driving the developing apparatus, wherein the unsealing mechanism unseals the sealing sheet sealing the initial developer by the driving force which the driving force receiving portion receives at a time of starting usage of the developing apparatus.

4. The developing apparatus according to claim 3, wherein:

the unsealing mechanism has a shaft, which is rotationally driven, onto which the sealing sheet is wound up; and the shaft is rotationally driven by the driving force which the driving force receiving portion receives at the time of starting usage of the developing apparatus and the sealing sheet is wound up onto the shaft so that the unsealing mechanism unseals the sealing sheet sealing the initial developer.

5. The developing apparatus according to claim 1, further comprising:

a first communication portion sealing sheet arranged opposite to the first communication portion in the second direction and configured to seal the initial developer contained in the developing container; and a second communication portion sealing sheet arranged opposite to the second communication portion in the second direction and configured to seal the initial developer contained in the developing container, wherein the unsealing mechanism unseals the sealing sheet, the first communication portion sealing sheet, and the second communication portion sealing sheet sealing the initial developer.

6. A developing apparatus, comprising:

a developer bearing member bearing and feeding developer including toner and carrier in order to develop an electrostatic image formed on an image bearing member;

a developing container including a first chamber and a second chamber partitioned by a partition wall from the first chamber, and configured to contain the developer to be supplied to the developer bearing member;

a first communication portion configured to permit movement of the developer from the first chamber to the second chamber;

a second communication portion configured to permit movement of the developer from the second chamber to the first chamber;

a first feeding screw arranged in the first chamber and feeding the developer in a first direction from the second communication portion toward the first communication portion;

a second feeding screw arranged in the second chamber and including a first blade portion feeding the developer in a second direction from the first communication portion to the second communication portion, and a second blade portion arranged downstream of the first blade portion in the second direction and feeding the developer in the first direction to deliver the developer through the second communication portion to the first chamber;

a developer replenishing portion configured to replenish replenishment developer to the developing container;

a developer discharging portion configured to discharge a part of the developer contained in the developing container as the replenishment developer is replenished to the developing container by the developer replenishing portion;

a sealing sheet arranged upstream of the developer discharging portion in the second direction and sealing initial developer contained in the developing container; and an unsealing mechanism unsealing the sealing sheet sealing the initial developer, wherein the sealing sheet is attached to a most downstream end of the second blade portion in the second direction.

7. The developing apparatus according to claim 6, further comprising a driving force receiving portion configured to receive a driving force, supplied from a driving source, for driving the developing apparatus, wherein the unsealing mechanism unseals the sealing sheet sealing the initial developer by the driving force which the driving force receiving portion receives at a time of starting usage of the developing apparatus.

8. The developing apparatus according to claim 7, wherein:

the unsealing mechanism has a shaft, which is rotationally driven, onto which the sealing sheet is wound up; and the shaft is rotationally driven by the driving force which the driving force receiving portion receives at the time of starting usage of the developing apparatus and the sealing sheet is wound up onto the shaft so that the unsealing mechanism unseals the sealing sheet sealing the initial developer.

9. The developing apparatus according to claim 6, further comprising:

a first communication portion sealing sheet arranged opposite to the first communication portion in the second direction and configured to seal the initial developer contained in the developing container; and a second communication portion sealing sheet arranged opposite to the second communication portion in the second direction and configured to seal the initial developer contained in the developing container, wherein the unsealing mechanism unseals the sealing sheet, the first communication portion sealing sheet, and the second communication portion sealing sheet sealing the initial developer.

* * * * *